US007043182B2

(12) United States Patent
Sakai et al.

(10) Patent No.: US 7,043,182 B2
(45) Date of Patent: May 9, 2006

(54) DEVELOPER REGULATING MEMBER, DEVELOPING DEVICE, ELECTROPHOTOGRAPHIC IMAGE FORMING PROCESS CARTRIDGE, AND IMAGE FORMING APPARATUS INCLUDING THE DEVELOPER REGULATING MEMBER

(75) Inventors: Kiyotaka Sakai, Yokohama (JP); Kazuyuki Sugihara, Yokohama (JP); Junichi Terai, Yokohama (JP); Kazuhisa Sudo, Kawasaki (JP); Katsumi Masuda, Tokyo (JP); Hiroyuki Nagashima, Yokohama (JP); Hideki Kimura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 66 days.

(21) Appl. No.: 10/665,286

(22) Filed: Sep. 22, 2003

(65) Prior Publication Data

US 2004/0114971 A1 Jun. 17, 2004

(30) Foreign Application Priority Data

Sep. 20, 2002 (JP) ..... 2002-275521
Nov. 25, 2002 (JP) ..... 2002-341434

(51) Int. Cl.
*G03G 15/08* (2006.01)
*G03G 21/20* (2006.01)
*G03G 15/09* (2006.01)

(52) U.S. Cl. ..... 399/284; 399/94; 399/274

(58) Field of Classification Search ..... 399/92, 399/94, 222, 252, 274, 284; 430/105, 106.1, 430/107.1, 108.1, 110.1, 110.3, 111.35, 111.4
See application file for complete search history.

(56) References Cited

U.S. PATENT DOCUMENTS 4,920,916 A * 5/1990 Mizuno et al. ..... 399/284
5,220,129 A * 6/1993 Nishio et al. ..... 399/284
5,895,146 A * 4/1999 Waki et al. ..... 399/170
5,999,772 A 12/1999 Kakitani et al.
6,377,769 B1 * 4/2002 Kakimoto ..... 399/284
6,393,241 B1 5/2002 Matsumoto et al.

(Continued)

FOREIGN PATENT DOCUMENTS

EP 1 128 229 8/2001

(Continued)

OTHER PUBLICATIONS

U.S. Appl. No. 10/943,950, filed Sep. 20, 2004, Sudo et al.

(Continued)

*Primary Examiner*—Sandra L. Brase
(74) *Attorney, Agent, or Firm*—Oblon, Spivak, McClelland, Maier & Neustadt, P.C.

(57) ABSTRACT

A developing device includes a developer carrier and a developer regulating member including a developer regulating part opposing a surface of the developer carrier to regulate the developer carried and conveyed by the developer carrier. The developer regulating member is formed from a single metallic member and includes a space that faces an inner surface of the metallic member. The space extends in a direction perpendicular to a moving direction of the surface of the developer carrier. The developing device can include a cooling device that cools the developer regulating member from an inner surface side of the metallic member facing the space.

33 Claims, 15 Drawing Sheets

U.S. PATENT DOCUMENTS

| | | | | |
|---|---|---|---|---|
| 6,501,913 | B1 | 12/2002 | Hattori et al. | |
| 6,522,855 | B1 | 2/2003 | Katoh et al. | |
| 6,577,836 | B1 * | 6/2003 | Yamashita et al. | 399/307 |
| 6,591,077 | B1 | 7/2003 | Yanagisawa et al. | |
| 6,615,014 | B1 | 9/2003 | Sugihara | |
| 6,628,908 | B1 | 9/2003 | Matsumoto et al. | |
| 6,665,508 | B1 | 12/2003 | Sudo et al. | |
| 6,787,280 | B1 * | 9/2004 | Yamashita et al. | 430/111.4 |
| 2004/0114971 | A1 | 6/2004 | Sakai et al. | |
| 6,229,980 | B1 | 5/2001 | Ogawa et al. | |
| 6,336,020 | B1 | 1/2002 | Ishikawa et al. | |
| 6,337,957 | B1 | 1/2002 | Tamaki et al. | |
| 6,226,481 | B1 | 5/2001 | Yoneda et al. | |
| 6,070,037 | A | 5/2000 | Sugihara et al. | |
| 6,077,635 | A * | 6/2000 | Okado et al. | 430/110.3 |
| 6,083,652 | A * | 7/2000 | Duggan et al. | 430/111.35 |
| 6,122,469 | A | 9/2000 | Miura et al. | |

FOREIGN PATENT DOCUMENTS

| | | |
|---|---|---|
| JP | 6-64396 | 3/1988 |
| JP | 5-216281 | 8/1993 |
| JP | 10-186845 | 7/1998 |
| JP | 11-174795 | 7/1999 |
| JP | 2000-330381 | 11/2000 |
| JP | 2001-83799 | 3/2001 |
| JP | 2001-235942 | 8/2001 |
| JP | 2001-330992 | 11/2001 |
| JP | 2002-169375 | 6/2002 |
| JP | 2002-207309 | 7/2002 |
| JP | 2002-207321 | 7/2002 |
| JP | 2002-229323 | 8/2002 |
| JP | 2002-229337 | 8/2002 |
| JP | 2002-258600 | 9/2002 |

OTHER PUBLICATIONS

U.S. Appl. No. 10/665,286, filed Sep. 22, 2003, Sakai et al.
U.S. Appl. No. 10/836,264, filed May 3, 2004, Shintani et al.
U.S. Appl. No. 10/820,726, filed Apr. 9, 2004, Koike et al.
U.S. Appl. No. 10/798,382, filed Mar. 12, 2004, Ishibashi.
U.S. Appl. No. 09/148,509, filed Sep. 4, 1998, Kakitani et al.
U.S. Appl. No. 09/994,620, filed Nov. 28, 2001, Hayashi et al.
U.S. Appl. No. 09/997,002, filed Nov. 30, 2001, Semma et al.
U.S. Appl. No. 10/075,462, filed Feb. 15, 2002, Terai.
U.S. Appl. No. 10/133,484, filed Apr. 29, 2002, Hattori et al.
U.S. Appl. No. 10/163,990, filed Jun. 7, 2002, Yamada et al.
U.S. Appl. No. 10/188,754, filed Jul. 5, 2002, Terai.
U.S. Appl. No. 10/212,714, filed Aug. 7, 2002, Sugihara.
U.S. Appl. No. 10/268,790, filed Oct. 11, 2002, Sugihara.
U.S. Appl. No. 10/303,987, filed Nov. 26, 2002, Azami et al.
U.S. Appl. No. 10/329,356, Dec. 27, 2002, Muramatsu et al.
U.S. Appl. No. 10/355,119 Jan. 31, 2003, Ozeki et al.
U.S. Appl. No. 10/357,393, filed Feb. 4, 2003, Terai.
U.S. Appl. No. 11/197,548, filed Aug. 5, 2005, Kasai et al.
U.S. Appl. No. 11/040,003, filed Jan. 24, 2005, Terai.

* cited by examiner

DEVELOPER REGULATING MEMBER, DEVELOPING DEVICE, ELECTROPHOTOGRAPHIC IMAGE FORMING PROCESS CARTRIDGE, AND IMAGE FORMING APPARATUS INCLUDING THE DEVELOPER REGULATING MEMBER

CROSS-REFERENCE TO RELATED APPLICATIONS

The present application claims priority to Japanese Patent Application No. 2002-275521 filed in the Japanese Patent Office on Sep. 20, 2002 and Japanese Patent Application No. 2002-341434 filed in the Japanese Patent Office on Nov. 25, 2002, the disclosures of which are incorporated herein by reference in their entirety.

BACKGROUND OF THE INVENTION

1. Field of the Invention

The present invention relates to a developer regulating member that regulates a developer carried and conveyed by a developer carrier, and to a developing device, an electrophotographic image forming process cartridge, and an image forming apparatus including the developer regulating member.

2. Background of the Art

A developing device, in which a developer carried on a developer carrier is regulated by a developer regulating member and conveyed to a developing area where the developer carrier faces an image carrier, such as, a photoreceptor, has been widely used in an image forming apparatus, such as, a copying machine, a printer, a facsimile machine, or other similar image forming apparatuses. In the developing area, an electrostatic latent image formed on the image carrier is developed with a developer carried on the developer carrier. A developing device using a two-component developer containing toner and magnetic carrier includes a developing sleeve as a developer carrier. The developing sleeve includes a magnetic field generating member inside, carries a two-component developer thereon by a magnetic force generated by the magnetic field generating member, and conveys the developer to a developing area while rotating. An amount (i.e., a thickness) of the developer carried on the developing sleeve is regulated by a developer regulating member spaced apart from the surface of the developing sleeve while the developer passes through a gap formed between an edge of the developer regulating member and the surface of the developing sleeve. Such a developer regulating member is described, for example, in Japanese patent publication No. 6-064396.

At a developer regulating position, where a developer regulating member regulates a developer carried and conveyed by a developer carrier, heat is produced by the friction between the developer regulating member and the developer, the surface of the developer carrier and the developer, and between the developer particles. The rise in developer temperature typically decreases the developing ability of the developer and deteriorates the developer, resulting in a short useful lifetime of the developer. For example, when using a two-component developer including a toner and a magnetic carrier, the rise in developer temperature at the developer regulating position decreases the amount of toner charged, thereby deteriorating the developing ability of the developer. Further, external additives added to the developer typically become embedded in softened toner particles, thereby changing the shape of the magnetic carrier due to direct contact between magnetic carrier particles. As a result, the developer deteriorates.

Moreover, the rise in toner temperature in the developer may cause a so-called toner filming problem. Specifically, when the temperature of toner rises at the developer regulating position, the toner softens and fuses. In this condition, a film made of fused toner adheres to a surface of a developer carrier, thereby deteriorating the developing performance of the developer carrier. Therefore, it is desirable to provide a developer regulating member that efficiently prevents the rise in developer temperature caused by the heat produced at the developer regulating position, and to provide a developing device, an electrophotographic image forming process cartridge, and an image forming apparatus comprising such a developer regulating member.

Several techniques have been proposed to control the temperature rise of a developer at a developer regulating position. For example, published Japanese patent application No. 2001-235942 describes a developing device having a heat radiating surface in contact with the developer regulating member and a cooling device to cool the heat radiating surface. In this developing device, in order to make the temperature in the longitudinal direction of the developer regulating member uniform, a heat pipe is embedded in the heat radiating surface. Alternatively, a heat pipe can also be fixed to the developer regulating member.

Another example is the published Japanese patent application No. 2001-083799, which describes a developing device including a developer regulating member formed from a thin, sheet-shaped, hard plastic member such as, polyethylene terephthalate. The developer regulating member is deflected so as to bulge toward at least a developer carrier side. The bulge portion of the developer regulating member is deformed along the circumferential surface of the developer carrier. On the inner (rear) surface of the developer regulating member, a heat conduction layer made of a material having a higher heat conductivity than the plastic is formed. Alternatively, a plurality of protrusions made of a material having a higher heat conductivity than the plastic is formed on the inner surface of the developer regulating member.

An amount of developer having passed through a gap (hereinafter referred to as a "developer regulating gap") between the developer regulating member and the developer carrier per unit area is referred to as an amount of developer to be scooped up. When the amount of the developer scooped up is large relative to a gap in a developing area where the developer carrier opposes the image carrier, developer particles are pressed against each other in the developing area. In this condition, frictional heat is produced due to shear stress, thereby fusing the developer and causing it to adhere to the surface of the developer carrier. When the amount of the developer scooped up is small, a sufficient amount of toner cannot be supplied to the image carrier, resulting in a decrease of image density. Therefore, to obtain a stable, high-quality image, an adequate amount of developer scooped up needs to be conveyed to the developing area.

The developer regulating member 110 illustrated in FIG. 1 has been widely used. The developer regulating member 110 is formed by bending a metal plate member along a bending line. A leading edge surface 111 of the developer regulating member 110 is provided opposite to a surface of a developing sleeve to regulate the amount of developer carried on the developing sleeve. Generally, the leading edge surface 111 is formed by a press cutting process, which causes the leading edge surface 111 to be uneven in its longitudinal direction. Thus, when using the leading edge surface 111 as a developer regulating part of the developer regulating member 110, the amount of developer scooped up tends to be uneven in the longitudinal direction of the developing sleeve. For this reason, the leading edge surface 111 is generally subjected to a secondary manufacturing process, such as, cutting and grinding, thus increasing the manufacturing cost of the developer regulating member.

FIG. 2 illustrates some developer in a space between the developer regulating member 110 and the developing sleeve 165. The leading edge surface 111 of the developer regulating member 110 is separated from the developing sleeve 165 by a developer regulating gap. As illustrated in FIG. 2, gap (a) between the leading edge surface 111 and the developing sleeve 165 at an inlet side is greater than gap (b) where the developer regulating member 110 is the closest to the developing sleeve 165. The gap between the developer regulating member 110 and the developing sleeve 165, from the location of gap (a) to that of gap (b), is in the shape of a wedge. When developer is conveyed into the wedge-shaped gap, developer particles are pressed against each other, thereby producing stress. This is known as a wedge effect, which generates a reaction force that is detrimental to the developer regulating member 110.

Generally, the developer regulating member 110 illustrated in FIG. 1 is fixed to a developing device at two end portions (right and left side end portions in FIG. 1) of a base part 112 such that the leading edge surface 111 opposes a developing sleeve. As illustrated in FIG. 1, the base part 112 includes an edge different from the edge including the leading edge surface 111. In this construction, the reaction force produced by the wedge effect is exerted on a center portion of the developer regulating member 110 rather than at both end portions (right and left side end portions in FIG. 1) and deforms a bent part around the center portion of the developer regulating member 110 in the developer conveying direction. When the leading edge surface 111 is displaced due to the deformation of the bent part around the center portion of the developer regulating member 110, the height of the developer regulating gap increases, thereby increasing the amount of the developer passing through the center portion of the developer regulating member 110 compared to that at both end portions. As a result, the amount of the developer delivered to the developing area where the developer carrier opposes an image carrier becomes uneven in the longitudinal direction of the developer carrier, thereby generating an uneven image density in the axial direction of the image carrier.

Thus, it is desirable to provide a developer regulating member that adequately and uniformly regulates the amount of developer carried on a longitudinal direction of the developer carrier and to provide a developing device, an electrophotographic image forming process cartridge, and an image forming apparatus such a developer regulating member.

SUMMARY OF THE INVENTION

According to one aspect of the present invention, a developer regulating member includes a developer regulating part opposing a surface of a developer carrier to regulate a developer carried and conveyed by the developer carrier. The developer regulating member is formed from a single metal member and includes a space that faces an inner surface of the metal member, which space extends in a direction perpendicular to a moving direction of the surface of the developer carrier.

According to another aspect of the present invention, a developing device includes a developer carrier configured to carry and convey a developer and the above-described developer regulating member.

The developing device may further include a cooling device configured to cool the developer regulating member from an inner surface side of the metal member facing the space.

According to another aspect of the present invention, an electrophotographic image forming process cartridge for use in an image forming apparatus includes at least an image carrier configured to carry an image and a developing device configured to develop a latent image to form a toner image on the image carrier. The developing device includes a developer carrier configured to carry and convey the developer, and the above-described developer regulating member.

According to yet another aspect of the present invention, an image forming apparatus includes an image carrier configured to carry an image, an exposing device configured to form a latent image on a surface of the image carrier, and a developing device configured to develop the latent image to form a toner image on the image carrier. The developing device includes a developer carrier configured to carry and convey the developer, and the above-described developer regulating member.

BRIEF DESCRIPTION OF THE DRAWINGS

A more complete appreciation of the present invention and many of the attendant advantages thereof will be readily obtained as the same becomes better understood by reference to the following detailed description, when considered in connection with the accompanying drawings, wherein.

DETAILED DESCRIPTION OF THE PREFERRED EMBODIMENTS

Figure 1:
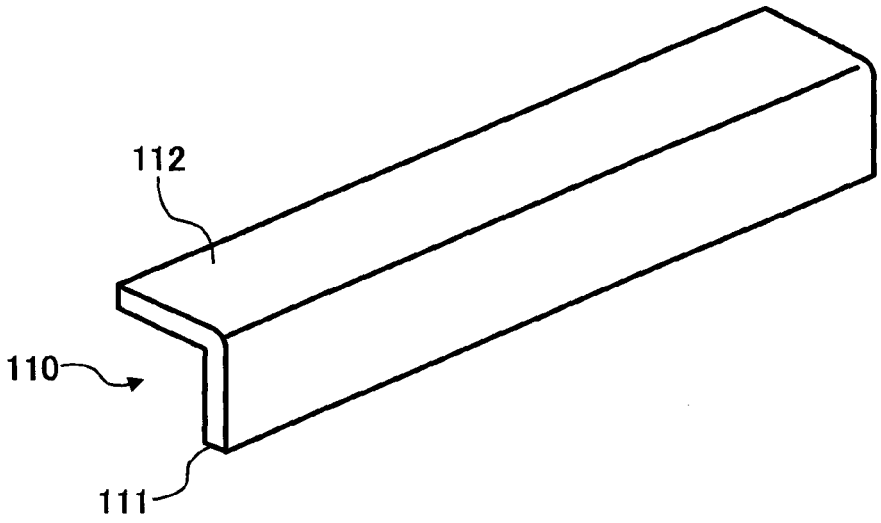
FIG. 1 BACKGROUND ART
FIG. 1 is a schematic perspective view of a background developer regulating member.

Preferred embodiments of the present invention are described in detail referring to the drawings, wherein like reference numerals designate identical or corresponding parts throughout the several views.

Hereinafter, an electrophotographic color copying machine, or simply referred to as a "color copying machine,") will be described as an example of an image forming apparatus according to an embodiment of the present invention.

At first, the developer for use in the color copying machine will be described. In this embodiment, the developer is a two-component developer which includes a toner and a magnetic carrier. The toner is typically prepared by dispersing a mixture of toner constituents including at least a prepolymer, a colorant, and a release agent in an aqueous medium in the presence of a particulate resin to perform an addition polymerization reaction. The method for manufacturing the toner will be described below, but the manufacturing method is not limited thereto.

Method for Manufacturing the Toner (1) Preparation of Mixture of Toner Constituents Toner constituents, i.e., a resin, a colorant, a wax, a charge controlling agent, and a polyester resin (i.e., a prepolymer) having an isocyanate group, are dissolved in an organic solvent such as ethyl acetate to prepare a toner constituent solution. At this point, the prepolymer is defined as a polymer having two or more reactive groups in its molecule.

(2) Emulsification

The above-prepared toner constituent solution and an amine are added to an aqueous medium including a surfactant, a viscosity controlling agent, and a particulate resin, and the mixture is dispersed while applying a shearing force thereto to prepare an emulsion.

(3) Aging

In order to accelerate the reaction (i.e., elongation reaction and/or crosslinking reaction) of the isocyanate group and the amine, the emulsion is heated.

(4) Removal of Solvent

For example, the emulsion is heated to evaporate the organic solvent present as drops in the emulsion, resulting in preparation of a dispersion of toner particles.

(5) Washing Using Alkali and Water

The toner particles are washed using an alkali and water to remove foreign substances (e.g., surfactant, viscosity controlling agent, etc.) present on the surface of the toner particles.

(6) Drying

The thus prepared toner particle dispersion is subjected to filtering and the wet cake is dried, completing the preparation of dry toner particles.

(7) Addition of External Additive

If desired, an external additive such as silica, titania and alumina is added to the dry toner particles in an amount varying from 0.1 to 5.0 parts by weight per 100 parts by weight of the toner particles. Mixing is performed using a mixer.

A method for manufacturing the toner will be specifically described below, but the manufacturing method is not limited thereto.

Manufacturing Example of Toner (1) Manufacturing Example of Polyester Resin

In a reaction container having a condenser, a stirrer, and a nitrogen introducing pipe, 690 parts of an adduct of bisphenol A with 2 moles of ethylene oxide, and 256 parts of terephthalic acid were reacted for 8 hours at 230° C. under a normal pressure. The mixture was further allowed to react for 5 hours under a reduced pressure varying between 10 to 15 mmHg. After the reaction product was cooled to 160° C., 18 parts of phthalic anhydride were added thereto to further induce a reaction for 2 hours. Thus, an unmodified polyester (a) was prepared.

(2) Manufacturing Example of a Prepolymer

In a reaction container having a condenser, a stirrer, and a nitrogen introducing pipe, 800 parts of an adduct of bisphenol A with 2 moles of ethylene oxide, 180 parts of isophthalic acid, 60 parts of terephthalic acid and 2 parts of dibutyl tin oxide were mixed. The mixture was then reacted for 8 hours at 230° C. under a normal pressure, And subsequently further for 5 hours under a reduced pressure varying between 10 mmHg to 15 mmHg. After the reaction product was cooled to 160° C., 32 parts of phthalic anhydride were added thereto to further induce a reaction for 2 hours. Then the reaction product was cooled to 80° C. and mixed with 170 parts of isophorondiisocyanate in ethyl acetate and reacted for 2 hours to prepare a prepolymer (1) having an isocyanate group.

(3) Preparation of Ketimine Compound

In a reaction container having a stirrer and a thermometer, 30 parts of isphoronediamine and 70 parts of methyl ethyl ketone were mixed and reacted at 50° C. for 5 hours. Thus, a ketimine compound (2) was prepared.

(4) Preparation of Toner

In a beaker, 15.4 parts of the prepolymer (1), 60 parts of the unmodified polyester resin (a) and 78.6 parts of ethyl acetate were mixed while stirring to dissolve the prepolymer (1) and the unmodified polyester resin (a). Then 10 parts of a rice wax release agent having a melting point of 83° C. and 4 parts of a copper phthalocyanine blue pigment were added thereto and the mixture was agitated at 60° C. by a TK HOMOMIXER, span at 12,000 rpm, to prepare a dispersion. Finally, 2.7 parts of the ketimine compound (2) were added thereto to be dissolved therein. Thus, a toner constituent solution (3) was prepared.

On the other hand, 306 parts of deionized water, 265 parts of a 10% aqueous suspension of tricalcium phosphate, 0.2 parts of sodium dodecylbenzenesulfonate, and a particulate styrene-acrylic resin having an average particle diameter of 0.20 μm were mixed in a container. The mixture was heated to 60° C., and then the above-prepared toner constituent solution (3) was added thereto while the mixture was agitated for 10 minutes by a TK HOMOMIXER at 12,000 rpm. Then 500 parts of the mixture was transferred to a container having a stirrer and a thermometer and heated to 45° C. under a reduced pressure to perform an urea reaction while removing the solvent. Then the dispersion was filtered, and the resultant toner particles were washed, dried, and, air-classified to prepare mother toner particles.

Then the following components were mixed in a Q-form mixer manufactured by Mitsui Mining Co., Ltd.

| | |
|---|---|
| The mother particles prepared above | 100 parts |
| Charge controlling agent (BONTRON E-84 from Orient Chemical Industries Co., Ltd.) | 0.25 parts |

The mixing conditions were as follows:

Rotational Speed of turbine blade: 50 m/s

Mixing operation: 5 cycles of a mixing operation for 2 minutes followed by a pause for 1 minute (i.e., the mixing operation was performed for 10 minutes in total).

Thus, toner particles were prepared.

Then 0.5 parts of a hydrophobic silica (H2000 manufactured by Clariant Japan K.K.) were added to the toner particles and the mixture was mixed in the Q-form mixer under the following conditions:

Rotational Speed of turbine blade: 15 m/s

Mixing operation: 5 cycles of a mixing operation for 30 seconds followed by a pause for 1 minute.

Thus, a cyan toner was prepared.

Then 100 parts of the toner, 0.5 parts of a hydrophobic silica, and 0.5 parts of a hydrophobized titanium oxide were mixed using a Henschel mixer.

Thus, a toner for use in the present embodiment was prepared.

The procedure for preparation of the above-prepared cyan toner was repeated except that 4 parts of the copper phthalocyanine blue pigment were replaced with 6 parts of a benzidine yellow pigment, 6 parts of a rhodamine lake pigment, or 10 parts of a carbon black, to prepare a yellow toner, a magenta toner, and a black toner respectively.

By using the above-prepared toners, the following effects can be produced.

(1) because the toners can be prepared without performing a pulverization operation, materials can be saved;

(2) the toners have a narrow particle diameter distribution;

(3) the toners have a sharp charge quantity distribution characteristic; and (4) the shape (e.g., circularity) of the toners can be easily changed.

Particle Diameter of Toner

The volume-based average particle diameter (Dv) of the above-described toner may vary from about 4 μm to about 8 μm, and the ratio of Dv to the number-based average particle diameter (Dn) is preferably from about 1.05 to about 1.30, and more preferably from about 1.10 to about 1.25. When such a toner is used, because the particle size distribution of toner is narrow, the following effects can be obtained.

(1) In a developing process, there is a phenomenon called "selection development" in which toner particles having an adequate toner particle diameter according to image patterns are selectively used for the development. Because the particle size distribution of toner is narrow, the "selection development" phenomenon does not tend to occur, and the toner is uniformly used. Therefore, a good quality image can be stably formed.

(2) When a toner recycle system is used, small toner particles, which are not easily transferred, are largely recycled. In addition, because the toner particle size distribution is narrow, the toner is uniformly used. Therefore, a good quality image can be stably formed.

(3) When the toner is used as a two-component developer while a cyclic operation of consumption and replenishment of the toner is frequently performed, the particle diameter of the toner particles in the two-component developer hardly changes, thereby leading to a stable development, i.e., good images can be stably produced for a long period of time even if the toner is agitated in the developing device.

(4) When the toner is used as a one-component developer while a cyclic operation of consumption and replenishment of the toner is frequently performed, the particle diameter of the toner particles in the one-component developer hardly changes. Further, the toner does not cause problems, such as the formation of a toner film on a developer carrier and the adhesion of toner to a member such as a blade configured to regulate the toner to form a thin toner layer. Therefore, even when the toner is used for a long period of time in a developing device while being agitated, a stable development can be performed and good images can be stably produced.

In general, the smaller particle diameter a toner has, the better image qualities (e.g., high resolution) the toner has. However, the smaller particle diameter a toner has, the worse transferability and cleaning property the toner has. When the toner has a volume-based average particle diameter (Dv) of less than 4 μm, the toner tends to adhere to the surface of the magnetic carrier contained in a two-component developer while the developer is agitated for a long period of time in a developing device, resulting in deterioration of the charging ability of the magnetic carrier. When such a small toner is used as a one-component developer, the toner tends to cause problems such that a toner film is formed on a developer carrier and the toner adheres to a member, such as a blade configured to regulate the toner, to form a thin toner layer. The same is true for the case in which a toner includes a large amount of fine toner particles.

In contrast, when the volume-based average particle diameter (Dv) of the toner is greater than 8 μm, it is hard to produce high resolution and high quality images. In addition, the particle diameter of the toner largely changes when a cyclic operation of consumption and replenishment is repeatedly performed. The same is true for the case in which the ratio Dv/Dn is greater than 1.30. When the ratio Dv/Dn is less than 1.05, it may be preferably used because the resultant toner particles have uniform performance and the charge quantity thereof is uniform. However, it may not be preferably used in the case when thin line images are developed with toner having small particles and solid images are developed with toner having large particles.

Method for Measuring Particle Diameter of Toner

The above-described particle diameter of toner can be measured by, for example, a Coultar counter method using a measuring instrument for measuring particle diameter distribution of toner, such as, Coultar counter TA-II or Coultar multisizer II (manufactured by Coulter Electronics Limited). To measure a particle diameter of toner using the measuring instrument, a surfactant (preferably an alkylbenzene sulfonate) in an amount of 0.1 ml to 5 ml serving as a dispersant is added to 100 ml or 150 ml to an aqueous electrolysis solution. As the electrolysis solution, an aqueous solution of NaCl at about 1% can be employed, prepared by using a first grade NaCl, for example, ISOTON-II (made by Coulter Electronics Limited). 2 mg to 20 mg of a toner sample to be measured is suspended in the aqueous electrolysis solution. The aqueous electrolysis solution in which the sample toner is suspended is subjected to dispersion treatment in an ultrasonic dispersion mixer for about 1 to 3 minutes.

By using the above-described measuring instrument, the particle diameter, the volume and the number of particles of the sample toner are measured, using a 100 μm aperture. The distribution of the volumes of toner particles, which may be referred to as the particle volume distribution, and the distribution of the numbers of toner particles, which may be referred to as the particle number distribution, are calculated from the particle diameter, the volume, and the number of particles of the sample toner measured. From the calculated distributions, the volume-based average particle diameter (Dv) and number-based average particle diameter (Dn) of toner particles are determined.

In the above-described measuring instrument, segments for measuring the particle diameter ranges are predetermined, which are referred to as channels. The user can choose the channels as desired. In accordance with the user's choice of the channels, all the values to be determined can be automatically obtained by the measuring instrument. In the above-mentioned measurement of the particle diameter and others, the following 13 channels were chosen in order to perform the measurement of the particle diameter in the range of 2.00 μm to less than 40.30 μm:

2.00 μm to less than 2.52 μm,
2.52 μm to less than 3.17 μm,
3.17 μm to less than 4.00 μm,
4.00 μm to less than 5.04 μm,
5.04 μm to less than 6.35 μm,
6.35 μm to less than 8.00 μm,
8.00 μm to less than 10.08 μm,
10.08 μm to less than 12.70 μm,
12.70 μm to less than 16.00 μm,
16.00 μm to less than 20.20 μm,
20.20 μm to less than 25.40 μm,
25.40 μm to less than 32.00 μm, and
32.00 μm to less than 40.30 μm.

Circularity and Distribution of Circularity

The toner for use in the present embodiment preferably has a specific form (i.e., circularity) and a specific form uniformity (i.e., specific circularity distribution). When the toner has an average circularity less than 0.93, i.e., the toner has a form largely different from a spherical form, high quality images cannot be produced (for example, transferability deteriorates and the resultant images have background fogging).

In the present embodiment, the circularity of a toner is measured as follows:

(1) a suspension including particles to be measured is passed through a detection area formed on a plate in the measuring instrument; and
(2) the shape of the particles are optically measured by a CCD camera and analyzed.

The circularity of a particle is determined by the following equation:

$$\text{Circularity}=Cs/Cp$$

where "Cp" represents the length of the circumference of the projected image of a particle, and "Cs" represents the length of the circumference of a circle having the same area as that of the projected image of the particle.

When the average circularity of a toner is from about 0.95 to about 0.99, the toner can stably produce images having a proper image density and high resolution. It is more preferable for the toner of the present embodiment that the average circularity is from about 0.96 to about 0.99 and the concentration of toner particles having a circularity less than 0.95 is not greater than 10%.

When the average circularity is greater than 0.99, toner particles remaining on the surface of a photoreceptor and a transfer belt cannot be properly removed by a cleaning blade (i.e., the photoreceptor is subjected to bad cleaning), thereby causing background fouling on the resultant images. When images having a low image area proportion are produced, the amount of toner particles remaining on a photoreceptor is little, and therefore the above-mentioned undesirable cleaning problem does not happen. However, when a color picture image, which has a high image area proportion, is copied, or when toner images accidentally remain on a photoreceptor due to mis-feeding of receiving paper, etc., the undesirable cleaning problem happens.

In addition, when toner particles remaining on a photoreceptor are not properly removed many times, the charger used for charging the photoreceptor is contaminated by the toner particles, resulting in a deterioration in charging ability of the charger.

Method for Measuring Circularity

The circularity of a toner can be determined by a flow-type particle image analyzer, FPIA-2100 manufactured by Toa Medical Electronics Co., Ltd.

Specifically, the method of determining the average circularity of a toner is as follows:

(1) 0.1 g to 0.5 g of a sample to be measured is mixed with 100 to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersion machine for about 1 to 3 minutes to prepare a suspension including particles of 3,000 to 10,000 per 1 μl of the suspension; and (3) the average circularity of the sample in the suspension is determined by the measuring instrument mentioned above.

By using the toner having the average circularity from about 0.95 to about 0.99, the following effects can be obtained:

(1) granularity of image is decreased;

(2) transfer efficiency is enhanced (toner amount (M/A) adhered onto a photoreceptor is decreased); and (3) torque is reduced.

Shape Factor of Toner

Figure 3:
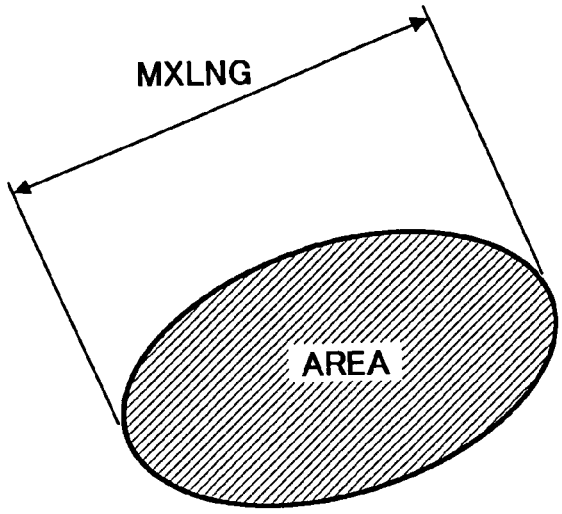
FIG. 3 illustrates a toner having an "SF-1" shape factor.

It is preferable that a shape factor "SF-1" of the toner is from about 120 to about 180, and a shape factor "SF-2" of the toner is from about 120 to about 190. Referring to FIG. 3, the shape factor "SF-1" is a parameter representing the roundness of a particle. The shape factor "SF-1" of a particle is calculated by the following equation:

$$SF\text{-}1=\{(MXLNG)^2/\text{AREA}\}\times(100\pi/4)$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 4:
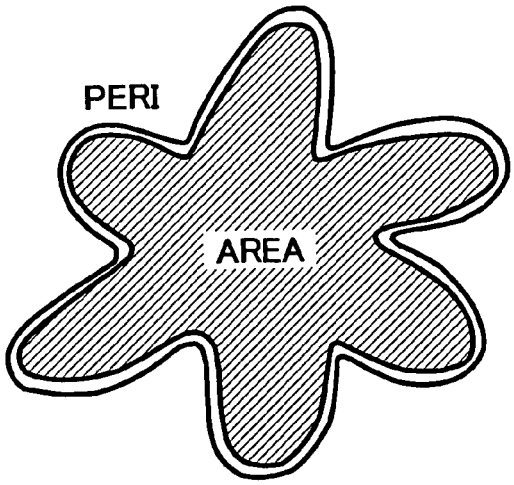
FIG. 4 illustrates a toner having an "SF-2" shape factor.

Referring to FIG. 4, the shape factor "SF-2" is a value representing irregularity (i.e., a ratio of convex and concave portions) of the shape of the material. The shape factor "SF-2" of a particle is calculated by the following equation:

$$SF\text{-}2=\{(PERI)^2/\text{AREA}\}\times(100/4\pi)$$

where "PERI" represents the perimeter of a figure obtained by projecting a toner particle on a two dimensional plane.

When the value of the shape factor "SF-2" is 100, the surface of the material is even (i.e., no convex and concave portions). As the value of the "SF-2" increases, the surface of the material becomes uneven (i.e., the number of convex and concave portions increase).

In this embodiment, toner images are sampled 100 times at random by using a field emission type scanning electron microscope (FE-SEM) S-800 made by HITACHI, Ltd. The toner image information is analyzed by using an image analyzer (LUSEX3) made by Nireko, Ltd. Then, respective values of shape factors are calculated by the above-described equations.

The inventors found that, as the toner shape becomes spherical, that is, the values of the shape factors "SF-1" and "SF-2" approach 100, the transfer efficiency increases. The reason for this observation is as follows. Because a toner particles an image carrier (e.g., a photoreceptor) are in point contact with each other due to their spherical shape, the fluidity of toner increases, and the adhesion force of toner to the image carrier decreases. As a result, the toner mobility becomes more easily controlled by a transfer electric field.

On the other hand, as the toner shape becomes spherical, mechanical cleaning becomes more difficult. This is because the toner easily passes through small clearances between a cleaning member and an image carrier due to the increase in toner fluidity and the decrease of toner adhesion forces to the image carrier. Therefore, considering cleaning performance, it is preferable that a toner has an irregular shape (i.e., the value of the shape factor "SF-1" exceeds 100) and an uneven surface (i.e., the value of the shape factor "SF-2" exceeds 100).

As described above, by using toner whose values of the shape factors "SF-1" and "SF-2" are in a predetermined range, the following effects can be obtained:

(1) torque can be reduced by enhancing toner fluidity of toner (i.e., prescribing the shape factor "SF-1"); and (2) cleaning performance can be enhanced.

The above-described toner is mixed with a magnetic carrier, and is used as a two-component developer. The particle diameter of the magnetic carrier is preferably from about 20 μm to about 50 μm. By using such a magnetic carrier, the granularity of image decreases, and a high quality image can be maintained for a long period of time. By reducing the particle diameter of the magnetic carrier and by determining the range of particle diameter, the thickness of a developer brush, by which charged toner is attached onto the carrier in the form of a chain in a developing process, can be uniformly decreased. Thereby, toner can be transferred from a developer carrier (i.e., a developing sleeve) to an image carrier (i.e., a photoreceptor) with higher precision. Further, the density of the developer brush per unit area on the developer carrier increases. Therefore, toner can be transferred more densely from the developer carrier onto a latent image on the image carrier.

For example, the magnetic carrier includes a core material covered with a resin coating layer. The resin coating layer preferably contains a melamine resin crosslinked with a thermoplastic resin, such as, an acrylic resin, and a charge controlling agent. By using such a magnetic carrier, the abrasion of the magnetic carrier in the developer can be prevented, and thereby preventing the change of developer conveying performance caused by the decrease of coefficient of friction between the developer carrier and the magnetic carrier. As a result, a high quality image can be maintained.

Next, construction and operation of a color copying machine will be described as an example of an image forming apparatus including a tandem-type image forming section according to an embodiment of the present invention.

Figure 5:
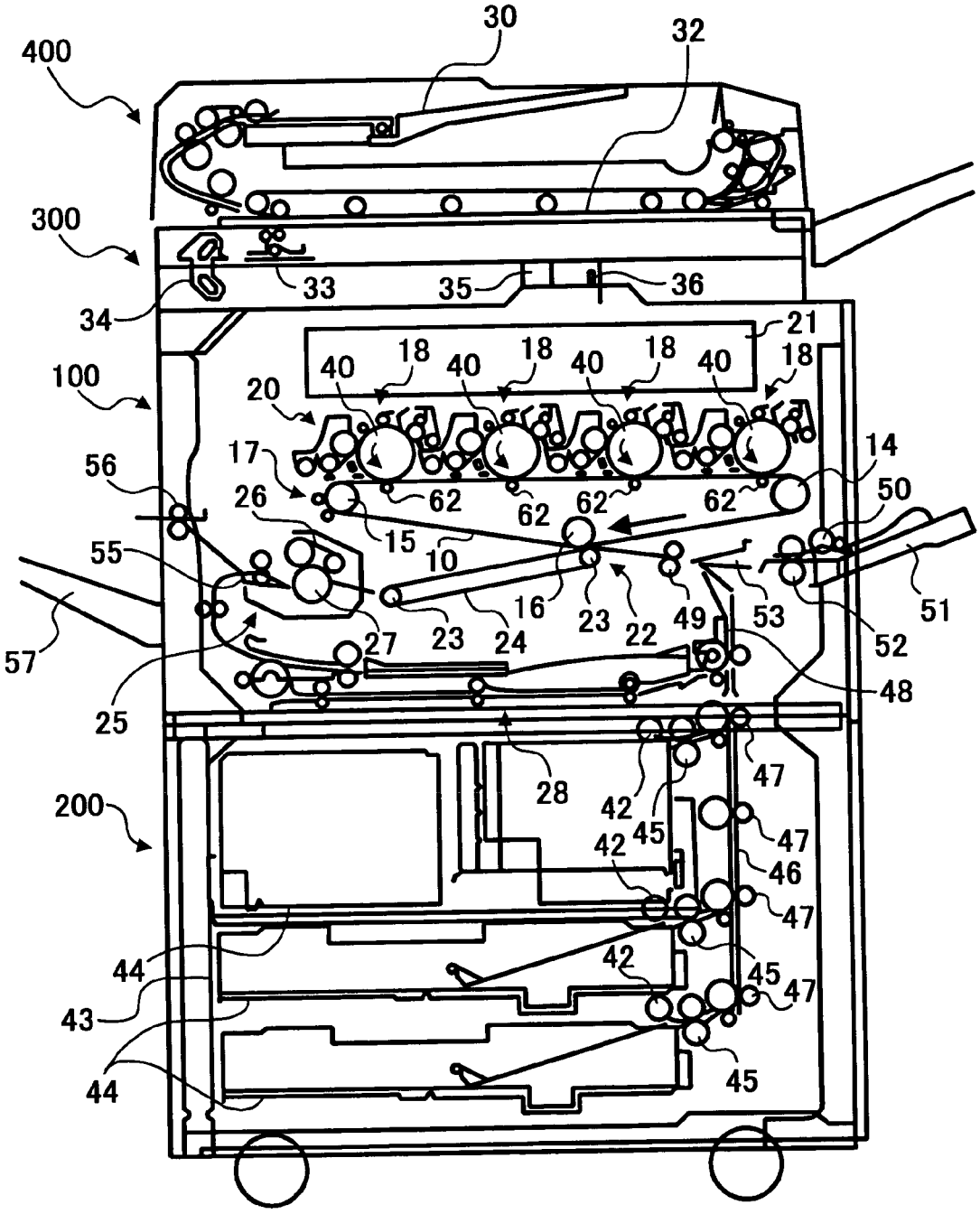
FIG. 5 is a schematic cross section of a color copying machine according to an embodiment of the present invention.

FIG. 5 is a schematic cross section of the color copying machine according to an embodiment of the present invention. The color copying machine includes a main body 100, a sheet feeding table 200, on which the main body 100 is mounted, a scanner 300 mounted on the main body 100, and an automatic document feeder 400 (ADF) mounted on the scanner 300.

An endless-belt-shaped intermediate transfer element 10 is provided at the center of the main body 100. The intermediate transfer element 10 is spanned around three support rollers 14, 15, and 16 and is configured to rotate in the clockwise direction in FIG. 5. A cleaning device 17 is provided at the left-hand side of the support roller 15 to remove residual toner remaining on the intermediate transfer belt 10 after image transfer. Four image forming devices 18 are arranged side by side above and along the upper and substantially horizontal run of the intermediate transfer belt 10 between the support rollers 14 and 15. The four image forming devices 18 are configured to form yellow, cyan, magenta, and black toner images, respectively.

In each of the image forming devices 18, there are provided a charging device, a developing device, a transfer roller 62 functioning as a primary transfer device, a photoconductive drum cleaning device, and a discharging device around a photoconductive drum 40 functioning as an image carrier. The detail of the construction of the image forming devices 18 will be described below. The four image forming devices 18 construct a tandem image forming section 20, in which toner images of different colors are formed on the photoconductive drums 40, respectively. Further, an exposing device 21 is provided above the image forming section 20.

On the side opposite from the tandem image forming section 20, a secondary transfer device 22 is provided below the lower run of the intermediate transfer element 10. In the secondary transfer device 22, an endless secondary transfer belt 24 is spanned around two rollers 23 and pressed against the support roller 16 via the intermediate transfer element 10. The secondary transfer device 22 is configured to transfer a color toner image from the intermediate transfer element 10 to a transfer sheet as a transfer material.

At a downstream side of a secondary transfer position in a transfer sheet conveying direction, a fixing device 25 is provided to fix a transferred color toner image to a transfer sheet. In the fixing device 25, a press roller 27 is pressed against an endless fixing belt 26. Further, a transfer sheet reversing device 28 is provided below the secondary transfer device 22 and the fixing device 25 to reverse a transfer sheet for forming images on dual sides of the transfer sheet (i.e., in a dual side copy mode). The transfer sheet reversing device 28 extends in parallel to the tandem image forming section 20.

When performing a copying operation in the color copying machine, an operator sets an original document on an original document tray 30 in the ADF 400. In another case, an operator opens the ADF 400, sets an original document on a contact glass 32 in the scanner 300, and then closes the ADF 400. When an original document is set on the original document tray 30 in the ADF 400, upon pressing a start switch (not shown), the ADF 400 conveys the original document to the contact glass 32. When an original document is set on the contact glass 32, upon pressing a start switch (not shown), the scanner 300 is immediately driven. In both the above-described cases, first and second carriages 33 and 34 in the scanner 300 are driven. A light source carried on the first carriage 33 irradiates an image surface of the original document with light. The light reflected from the image surface of the original document is directed to the second carriage 34. The light reflected from a mirror carried on the second carriage 34 is imaged on an image reading sensor 36 through an imaging lens 35.

Further, upon pressing a start switch (not shown), a drive motor (not shown) drives one of the support rollers 14 through 16, thereby rotating the intermediate transfer element 10. Almost simultaneously, in the image forming devices 18, the photoconductive drums 40 are rotated, so that black, yellow, magenta, and cyan toner images are formed on the photoconductive drums 40, respectively. While the intermediate transfer element 10 rotates, the black, yellow, magenta, and cyan toner images are sequentially transferred from the photoconductive drums 40 onto the intermediate transfer element 10 and are each superimposed thereon. As a result, a superimposed full-color toner image is formed on the intermediate transfer element 10.

Further, upon pressing a start switch (not shown), one of sheet feeding rollers 42 provided in the sheet feeding table 200 is driven to feed a transfer sheet out of one of a plurality of sheet feeding cassettes 44 provided in a paper bank 43. A separation roller 45 feeds transfer sheets one by one to a sheet feeding path 46. Then, sheet conveying rollers 47 convey the transfer sheet to a sheet conveying path 48 provided in the main body 100 of the color copying machine, causing the transfer sheet to abut against a pair of registration rollers 49. Alternatively, transfer sheets set on a manual sheet feeding tray 51 are fed out by rotating a sheet feeding roller 50. A separation roller 52 feeds transfer sheets one by one to a sheet feeding path 53. The transfer sheet also abuts against the registration rollers 49.

The registration rollers 49 start conveying the transfer sheet in synchronism with the rotation of the transfer belt 10 that carries the full-color toner image thereon, to a secondary transfer position between the intermediate transfer element 10 and the secondary transfer device 22. The secondary transfer device 22 transfers the full-color toner image from the intermediate transfer element 10 to the transfer sheet.

The endless secondary transfer belt 24 conveys the transfer sheet having the transferred full-color toner image to the fixing device 25. The fixing device 25 fixes the image on the transfer sheet under the influence of heat and pressure. Subsequently, a separation pick 55 directs the transfer sheet toward a sheet discharging roller 56. The transfer sheet is discharged by the sheet discharging roller 56 and stacked on a sheet discharging tray 57.

After the full-color toner image is transferred from the intermediate transfer element 10 to the transfer sheet, the cleaning device 17 removes residual toner remaining on the intermediate transfer element 10 for the next image forming operation.

Figure 6:
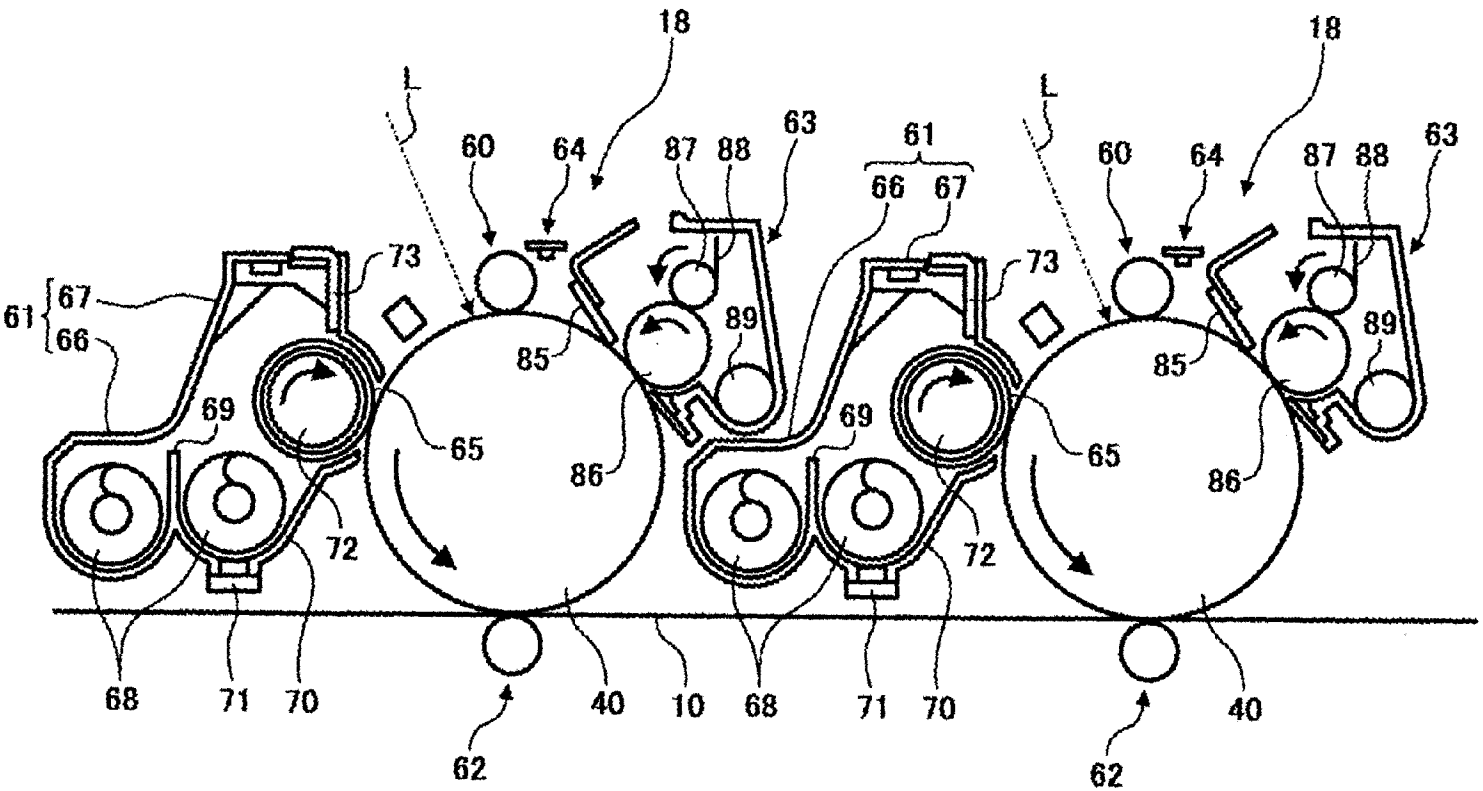
FIG. 6 is a schematic cross section of part of the image forming device of the color copying machine of FIG. 5.
Figure 7:
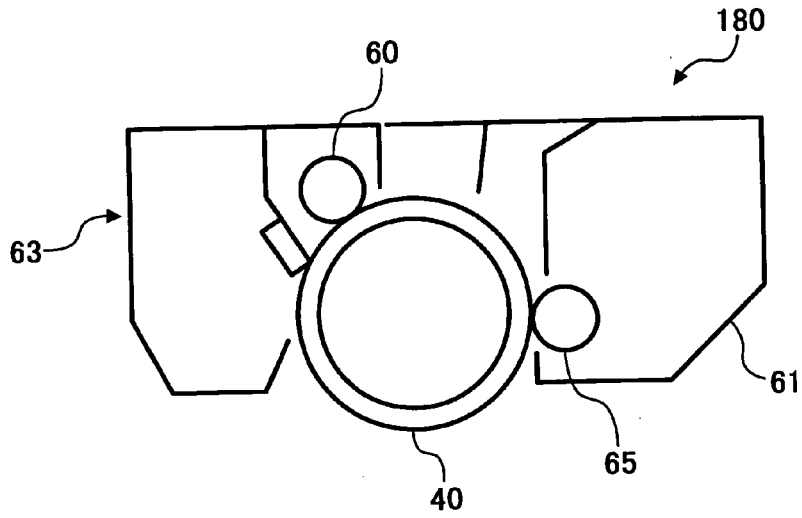
FIG. 7 is a schematic cross section of an electrophotographic image forming process cartridge according to the embodiment of the present invention.

Next, a description will be made of the image forming devices 18 in the tandem image forming section 20. FIG. 6 is a schematic cross section of a part of the image forming devices 18. As illustrated in FIG. 6, in each image forming device 18, arranged around the photoconductive drum 40 are a charging device 60, a developing device 61, a primary transferring device 62, a drum cleaning device 63 and a discharging device 64. The photoconductive drum 40 may be in a shape of an endless belt instead of a drum. In this embodiment, as illustrated in FIG. 7, the photoconductive drum 40, the charging device 60, the developing device 61, and the drum cleaning device 63 are integrally assembled in an electrophotographic image forming process cartridge 180. Alternatively, at least the photoconductive drum 40 and the developing device 61 may be integrally assembled in the electrophotographic image forming process cartridge 180. The electrophotographic image forming process cartridge 180 is detachably attached to the main body 100 of the color copying machine for easy maintenance. The electrophotographic image forming process cartridge 180 is replaced with a new one at the end of its useful life.

In this embodiment, the charging device 60 is constructed from a charging roller that charges the photoconductive drum 40 by applying voltages thereto. In this case, the charging roller contacts the photoconductive drum 40. In place of the charging roller, the charging device may be a non-contact type charging device, such as, a charger.

The developer used in the developing device 61 is a two-component developer including a mixture of a non-magnetic toner and a magnetic carrier. The developing device 61 is mainly constructed from a developer agitating section 66 and a developing section 67 (FIG. 6). The developer agitating section 66 conveys the developer while agitating the developer and supplies the developer to a developing sleeve 65. The developing section 67 transfers the toner in the developer from the developing sleeve 65 to the photoconductive drum 40. The developing sleeve 65 functions as a developer carrier. The developer agitating section 66 is positioned at a lower level than the developing section 67. The developer agitating section 66 includes two parallel screws 68 partitioned by a partition plate 69 except for both end portions thereof. Further, a toner density sensor 71 is attached to a case 70 for detecting the toner density of the developer. The developing sleeve 65 disposed in the developing section 67 faces the photoconductive drum 40 through an opening formed in the case 70. Further, a developer regulating member 73 is spaced a predetermined distance apart from the surface of the developing sleeve 65. The developing sleeve 65 is rotatably provided and formed from a non-magnetic sleeve-shaped member. The developing sleeve 65 includes a magnet roller 72.

In the developing device 61, the two screws 68 circulate the developer in the case 70 while agitating the developer and supply the developer to the developing sleeve 65. The magnet roller 72 magnetically scoops up the developer onto the developing sleeve 65. The scooped-up developer is held on the developing sleeve 65, forming a magnet brush. While the developing sleeve 65 rotates and conveys the magnet brush, the developer regulating member 73 regulates the height of the magnet brush (i.e., the amount of the developer). The excess developer removed by the developer regulating member 73 is returned to the developer agitating section 66.

The toner in the developer transferred from the developing sleeve 65 to the photoconductive drum 40 develops a latent image formed on the photoconductive drum 40 to form a toner image. After development, the developer remaining on the developing sleeve 65 leaves, at a position where the magnet roller 72 ceases to exert a magnetic force, and returns to the developer agitating section 66. When the density of toner in the developer agitating section 66 decreases due to repeated development, fresh toner is replenished to the developer agitating section 66 based on the detection result of the toner density sensor 71.

The drum cleaning device 63 includes a cleaning blade 85, made of, for example, polyurethane rubber, contacting the photoconductive drum 40 at its edge. A conductive fur brush 86 is rotatably held in contact with the photoconductive drum 40. Further, a metallic roller 87 is rotatably provided to apply a bias to the fur brush 86. The leading edge of a scraper 88 is pressed against the metallic roller 87. A screw 89 collects the toner removed from the photoconductive drum 40.

Specifically, the fur brush 86, rotating in a direction counter to the photoconductive drum 40, removes residual toner from the photoconductive drum 40. The metallic roller 87 rotates in a direction counter to the fur brush 86 while applying a bias to the fur brush 86, thereby removing the toner from the fur brush 86. Further, the scraper 88 removes the toner from the metallic roller 87. The screw 89 conveys the toner removed by the scraper 88 to a waste toner collection bottle (not shown) or returns it to the developing device 61 for reuse.

In the image forming devices 18, while the photoconductive drum 40 is rotated, the charging device 60 uniformly charges the surface of the photoconductive drum 40. Subsequently, the exposing device 21 irradiates the charged surface of the photoconductive drum 40 with a laser beam (L) in accordance with the scanned image information of the scanner 300, thereby forming an electrophotographic latent image on the photoconductive drum 40. The developing device 61 develops the electrophotographic latent image on the photoconductive drum 40 with toner, and forms a toner image. The toner image is transferred from the photoconductive drum 40 to the intermediate transfer element 10 by the primary transfer device 62. After image transfer, the drum cleaning device 63 removes residual toner on the photoconductive drum 40, and then the photoconductive drum 40 is uniformly discharged by the discharging device 64 to be prepared for the next image forming operation.

Hereafter, a construction of a developer regulating member according to an embodiment of the present invention will be described.

Figure 2:
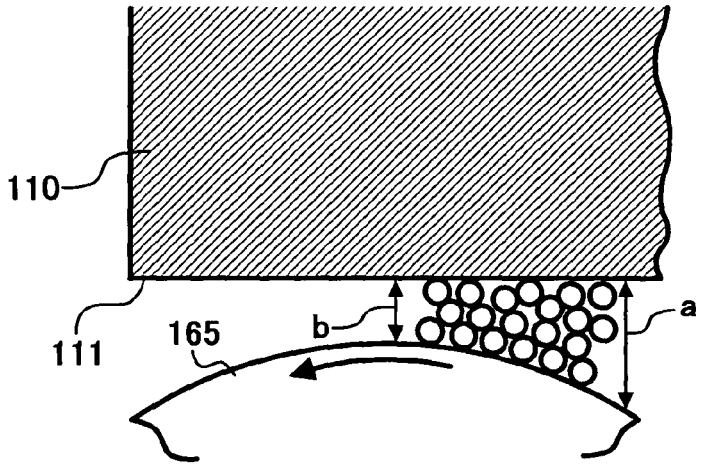
FIG. 2 BACKGROUND ART
FIG. 2 illustrates developer in a space between the background developer regulating member of FIG. 1 and a developing sleeve.

A background developer regulating member often has an L-shaped cross section as illustrated in FIG. 1. Referring back to FIGS. 1 and 2, as described above, the leading edge surface 111 of the developer regulating member 110 is provided opposite to the surface of the developing sleeve 165 with a predetermined gap to regulate an amount of developer carried on the developing sleeve 165. In the vicinity of the developer regulating gap (b) in FIG. 2, the developer is in a clogged condition and is pushed out of the developer regulating gap (b) by the rotation of the developing sleeve 165, by the friction between the surface of the developing sleeve 165 and the developer, by the friction between the developer regulating member 110 and the developer, and by the friction between developer particles. In this condition, the developer is subjected to a large amount of stress. Generally, the frictional energy tends to be dissipated in the form of heat or noise. Therefore, a significant amount of heat is produced at the developer regulating position of a conventional device, leading to an increase in the developer temperature and thereby causing other undesirable problems, such as, a decreased developing ability, a reduced useful lifetime of the developer, and formation of a toner film on the developing sleeve.

Figure 8:
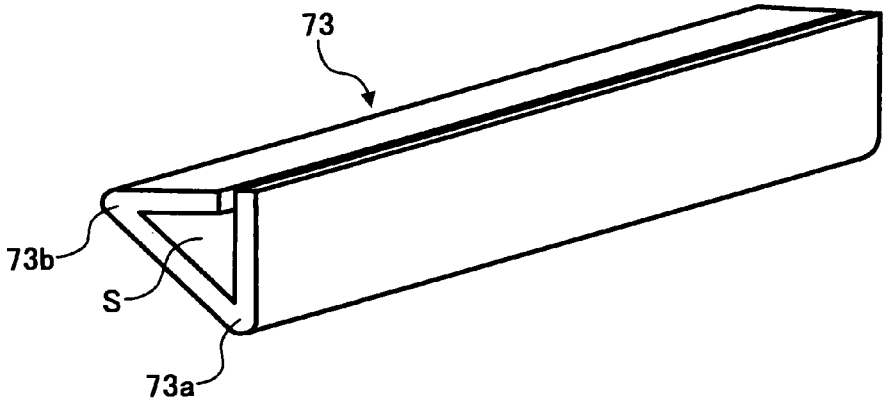
FIG. 8 is a schematic perspective view of a developer regulating member according to the embodiment of the present invention.

Therefore, to efficiently control the rise in developer temperature at the developer regulating position, a hollow developer regulating member 73 is used in the developing device 61. As illustrated in FIG. 8, the developer regulating member 73 includes a space and a developer regulating part 73*a*, opposing the surface of the developing sleeve 65, to regulate the amount of developer carried and conveyed by the developing sleeve 65. Further, there is provided a cooling device that cools the developer regulating member 73 from the inner surface side thereof facing the space.

Figure 9:
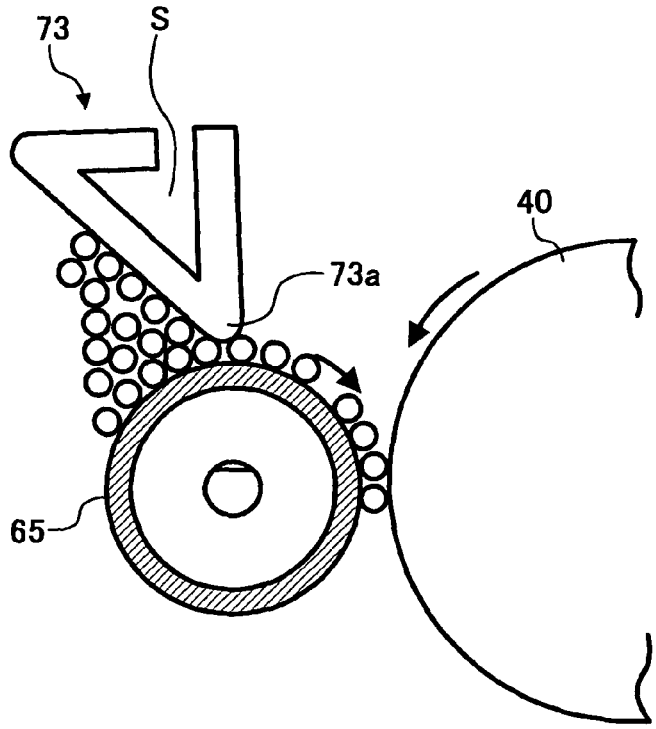
FIG. 9 is a schematic view of the developer regulating member of FIG. 8 attached to a developing device.

FIG. 9 is a schematic view of the developer regulating member 73 of FIG. 8 attached to a developing device. As illustrated in FIG. 8, the hollow developer regulating member 73 includes a space (S) that extends in a direction perpendicular to the moving direction of the surface of the developing sleeve 65, that is, in a longitudinal direction of the developer regulating member 73 along the rotational axis of the developing sleeve 65. Further, the developer regulating member 73 is formed from a single metal member, including alloyed metals, such as, for example, aluminum (having a thermal conductivity, k, of 236 $Wm^{-1\circ}C.^{-1}$), copper (k=403 $Wm^{-1\circ}C.^{-1}$), and iron (k=83.5 $Wm^{-1\circ}C.^{-1}$). As compared to plastic materials (k=1–3 $Wm^{-1\circ}C.^{-1}$), metals have a higher thermal conductivity. Because the developer regulating member 73 is made of metal, the heat generated at the developer regulating part 73*a* can be quickly transmitted to the entire inner surface of the metal member of the developer regulating member 73 facing the space (S), and subsequently dissipated from the developer regulating member 73. Further, a metallic developer regulating member 73, having a high rigidity, can be manufactured with higher tolerances (e.g., about 0.01 mm).

Figure 10:
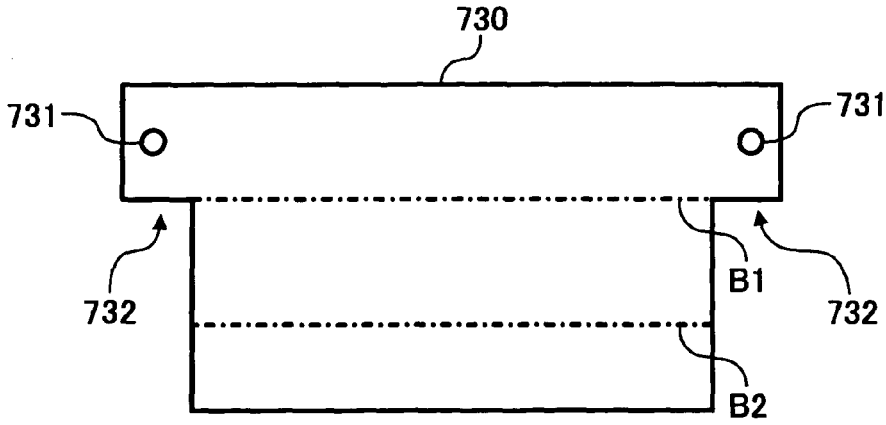
FIG. 10 is a schematic of a metallic plate member used to make the developer regulating member of FIG. 8.
Figure 11:
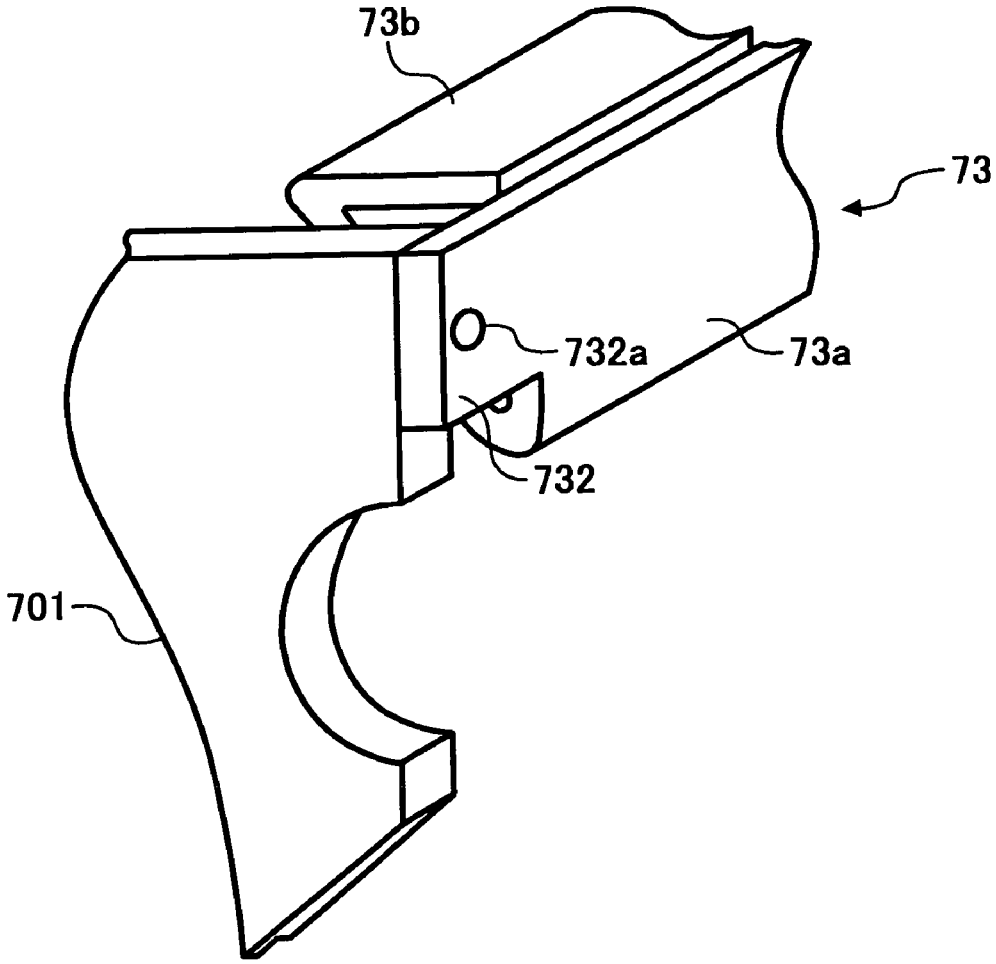
FIG. 11 is a schematic perspective view of the developer regulating member fixed to side plates of a case of a developing device.

For example, the developer regulating member 73 is formed by a press bending process. Specifically, the developer regulating member 73 is formed by bending a single metal plate member 730 (FIG. 10) along two bending lines (B1) and (B2), forming the space (S) (FIG. 8) that faces an inner surface of the metal plate member 730. The developer regulating member 73 has a substantially triangular section, and includes two bent parts 73*a* and 73*b* as illustrated in FIG. 8. Each of the angles formed between two sides at the bent parts 73*a* and 73*b* is less than 90 degrees. One of the two bent parts 73*a* and 73*b* (the bent part 73*a* in this embodiment) functions as a developer regulating part that opposes the surface of the developing sleeve 65 with a predetermined gap. Further, as illustrated in FIG. 10, the developer regulating member 73 includes projecting parts 732 at both end portions in its longitudinal direction. Each of the projecting parts 732 includes a hole 731 for attaching the developer regulating member 73 to side plates of the case 70 of the developing device 61. As illustrated in FIG. 11, the projecting parts 732 of the developer regulating member 73 are fixed to side plates 701 of the case 70 by screws 732*a*. Because the developing sleeve 65 is positioned relative to the side plates 701 of the case 70, the developer regulating member 73 can be fixed such that the developer regulating part 73*a* facing the developing sleeve 65 is spaced a predetermined distance apart from the surface of the developing sleeve 65.

Figure 12:
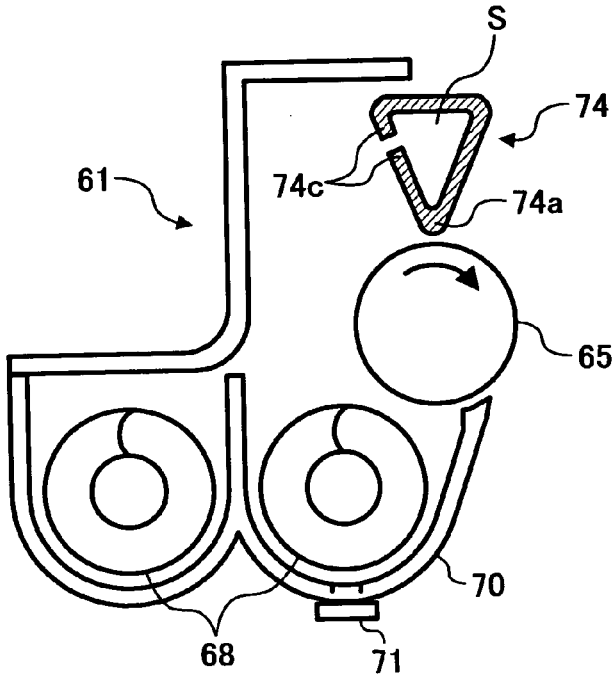
FIG. 12 is a schematic cross sectional view of a developer regulating member provided in the developing device according to an alternative embodiment.
Figure 13:
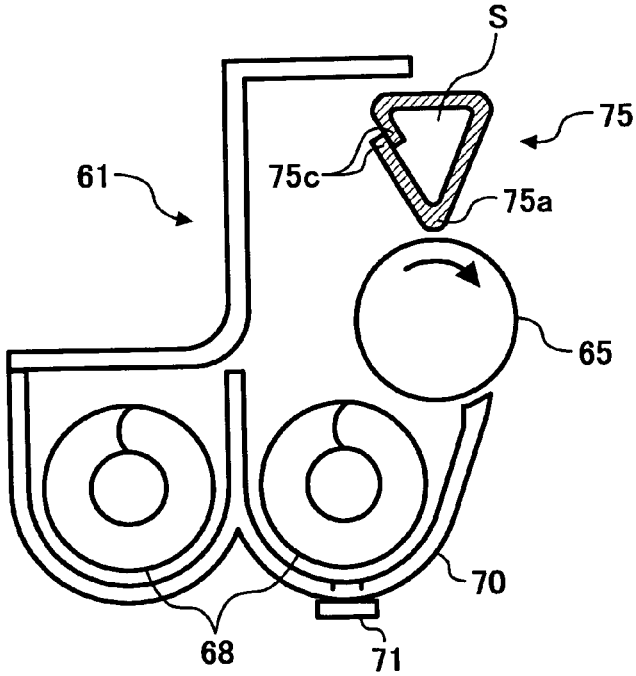
FIG. 13 is a schematic cross sectional view of a developer regulating member provided in the developing device according to another alternative embodiment.

FIGS. 12 and 13 are schematic cross sectional views of developer regulating members 74 and 75 provided in the developing device 61 according to alternative embodiments. Each of the developer regulating members 74 and 75 is formed by bending a single metal plate member and includes a space (S) facing the inner surface of the metal plate member. Each space (S) in the developer regulating members 74 and 75 extends in a direction perpendicular to the moving direction of the surface of the developing sleeve 65. In this exemplary embodiment, each of the developer regulating members 74 and 75 has a substantially isosceles triangular cross section.

The developer regulating member 74 illustrated in FIG. 12 includes a developer regulating part 74*a* opposing the developing sleeve 65 and two end parts 74*c* and is formed such that the two end parts 74*c* are opposite to and spaced apart from each other on the upstream side of the developer regulating member 74 with respect to the moving direction of the developing sleeve 65. On the other hand, the developer regulating member 75 illustrated in FIG. 13 includes a developer regulating part 75*a* opposing the developing sleeve 65 and two end parts 75*c* and is formed such that the two end parts 75*c* overlap one another on the upstream side of the developer regulating member 75 with respect to the moving direction of the developing sleeve 65. In the developer regulating member 75, one of the overlapping two end parts 75*c* closer to the developer regulating part 75*a* is located at the outer side. With such a construction, the deformation of the developer regulating part 75*a* is suppressed as compared to the developer regulating member 74 of FIG. 12. As a result, the gap formed between the developer regulating part 75*a* and the surface of the developing sleeve 65 at a developer regulating position is hardly changed.

Figure 14:
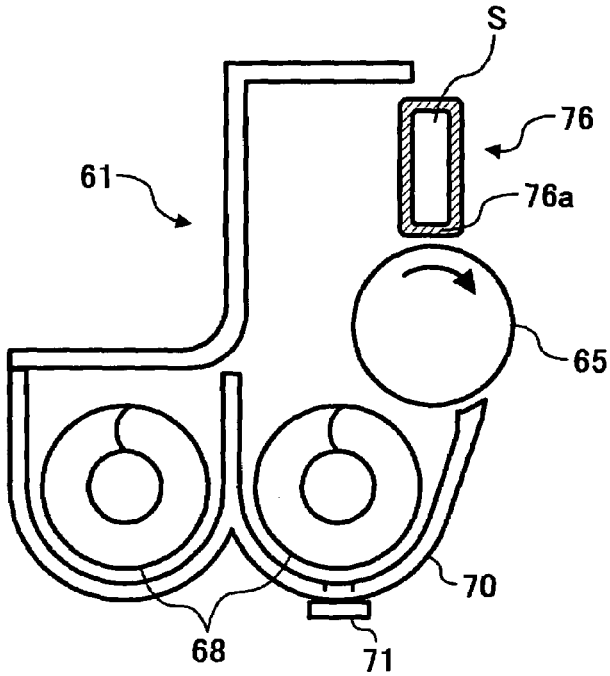
FIG. 14 is a schematic cross sectional view of a developer regulating member provided in the developing device according to yet another alternative embodiment.
Figure 15:
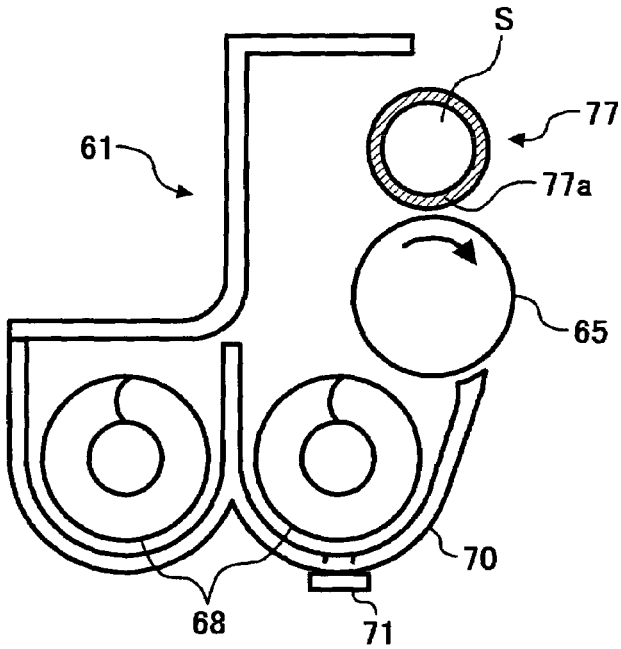
FIG. 15 is a schematic cross sectional view of a developer regulating member provided in the developing device according to another alternative embodiment.

FIGS. 14 and 15 are schematic cross sectional views of developer regulating members 76 and 77 provided in the developing device 61 according to other alternative embodiments. Each of the developer regulating members 76 and 77 is formed from a pipe-shaped single metal member such that the developer regulating member 76 or 77 includes a space (S) facing the inner surface of the pipe-shaped metal member. Each space (S) in the developer regulating members 76 and 77 extends in a direction perpendicular to the moving direction of the surface of the developing sleeve 65. The developer regulating member 76 has a rectangular section, as illustrated in FIG. 14, and includes a developer regulating part 76*a* opposing the developing sleeve 65. The developer regulating member 77 has a circle section, as illustrated in FIG. 15, and includes a developer regulating part 77*a* opposing the developing sleeve 65. These developer regulating members 76 and 77 can be easily formed by cutting pipes at a predetermined length. Each shape of the cross sections of the developer regulating members 76 and 77 may be any shape instead of a rectangle or a circle.

Figure 16:
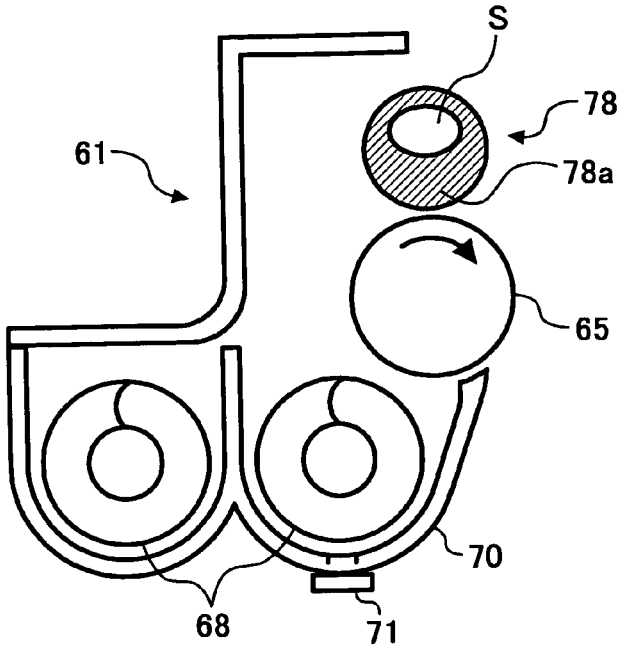
FIG. 16 is a schematic cross sectional view of a developer regulating member provided in the developing device according to another alternative embodiment.

FIG. 16 is a schematic cross sectional view of a developer regulating member 78 provided in the developing device 61 according to another alternative example. The developer regulating member 78 is formed from a single metal bar member including a space (S) and a developer regulating part 78*a* opposing the developing sleeve 65. Specifically, the developer regulating member 78 is formed by drilling a single metal bar member. The space (S) faces the inner surface of the metallic member and extends in a direction perpendicular to the moving direction of the surface of the developing sleeve 65, similar to the other above-described developer regulating members.

Figure 17:
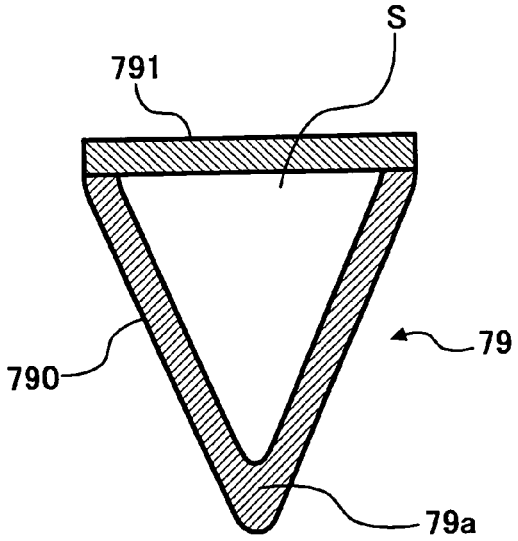
FIG. 17 is a schematic cross sectional view of a developer regulating member according to another alternative embodiment.

FIG. 17 is a schematic cross sectional view of a developer regulating member 79 according to another alternative example. The developer regulating member 79, constructed from a metal plate member 790, has a V-shaped cross section, a developer regulating part 79*a*, and a cover member 791 provided in tight contact with the upper surface of the metal plate member 790. A space (S) is formed in the developer regulating member 79 surrounded by the metal plate member 790 and the cover member 791. The cover member 791 may be formed from metal or a material other than metal.

Figure 18:
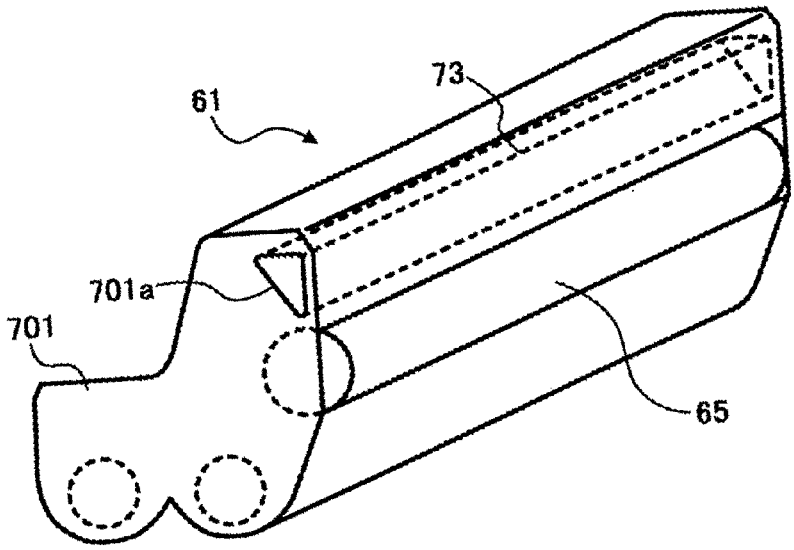
FIG. 18 is a schematic perspective view of the developer regulating member provided in the developing device in which heat in the developer regulating member is dissipated through openings formed in the side plates of the developing device.

Various cooling devices may be used to cool the above-described developer regulating members from the inner surface sides of the metal members of the developer regulating members that face the spaces (S). For example, in the developing device 61 illustrated in FIG. 18, openings 701*a* are formed in the side plates 701 of the developing device 61 at the positions where both end portions of the developer regulating member 73 are fixed to the side plates 701. Each opening 701*a* is shaped like the shape of the cross section of the developer regulating member 73. The heat in the space (S) is dissipated through the openings 701*a*. Further, an airflow may be produced in the space (S) in the developer regulating member 73 through the openings 701*a* by using an airflow generating device, such as a fan, provided in the color copying machine, thereby reducing the number of parts and the cost of the apparatus.

Figure 19:
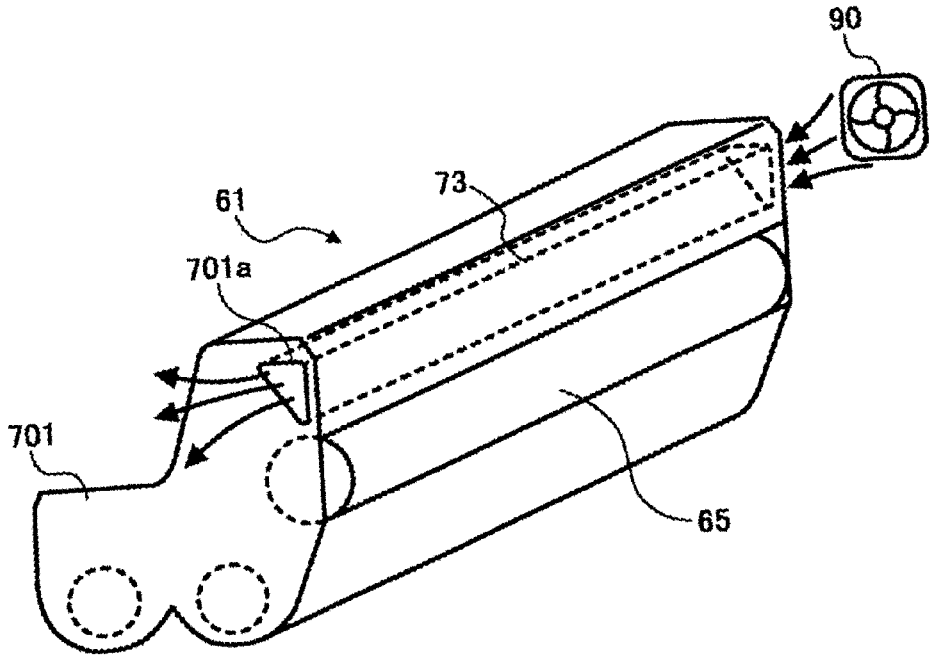
FIG. 19 is a schematic perspective view of the developer regulating member and a cooling device provided in the developing device according to an alternative embodiment.

Further, as an example of the cooling device for the developer regulating member 73, as illustrated in FIG. 19, an air supplying device, such as a fan 90, may be provided to supply air into the space (S) in the developer regulating member 73. In this case, because the fan 90 is provided adjacent to the developer regulating member 73 and provided exclusively for cooling the developer regulating member 73, a sufficient amount of air can be supplied into the space (S). An airflow guiding member may be provided between the fan 90 and one of the openings 701*a* in the side plate 701 to direct an airflow into the space (S). With such an airflow guiding member, the air supplied from the fan 90 is efficiently directed to the space (S), thereby enhancing the heat transfer process.

When supplying air into the developer regulating member 73 by the cooling device, such as a fan, the temperature of the air supplied by the cooling device is preferably lower than that of outside air for enhancing cooling effects. Further, the humidity of the air supplied by the cooling device is preferably lower than that of outside air for preventing the charging performance of the developer from being deteriorated.

Figure 20:
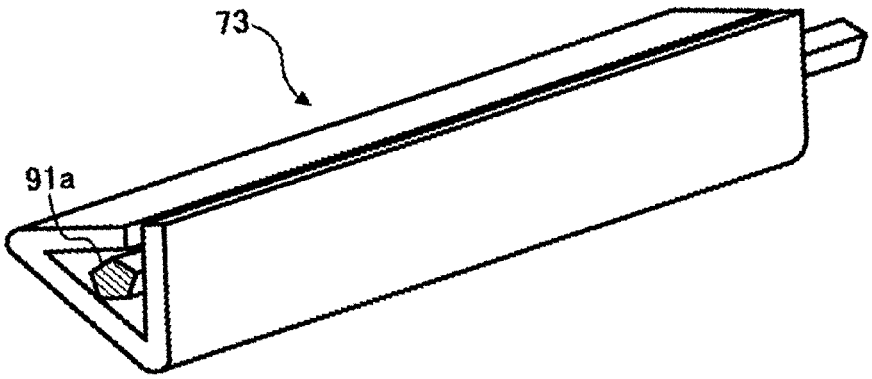
FIG. 20 is a schematic perspective view of the developer regulating member in which a cooling device is provided according to another alternative embodiment.
Figure 21:
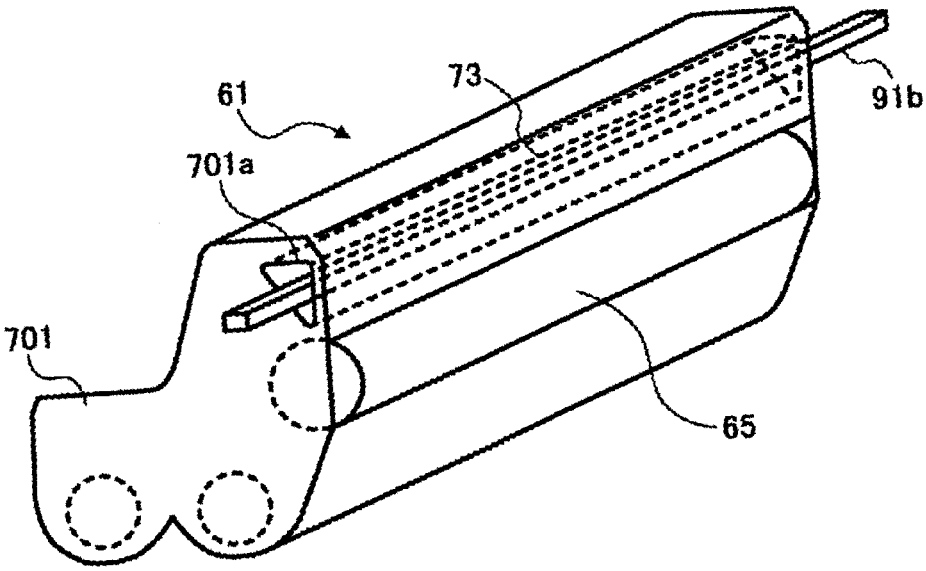
FIG. 21 is a schematic perspective view of the developer regulating member provided in the developing device in which a cooling device is provided in the developer regulating member according to yet another alternative embodiment.
Figure 22:
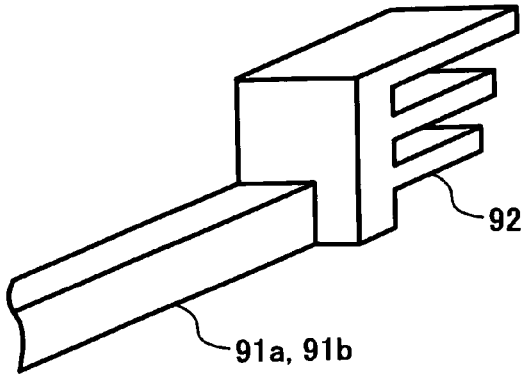
FIG. 22 is an enlarged view of an end portion of the cooling device and a cooling fin attached to the end portion of the cooling device.
Figure 23:
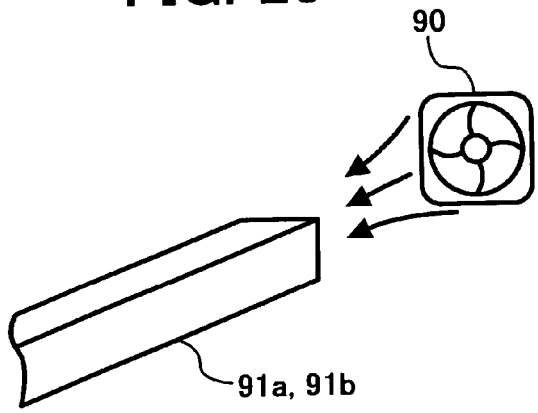
FIG. 23 is an enlarged view of an end portion of the cooling device and a fan that supplies air to the end portion thereof.

As an alternative, as illustrated in FIGS. 20 and 21, a cooling bar 91*a* or 91*b* made of metal may be provided as a cooling device such that the cooling bar 91*a* or 91*b* runs through the space (S) in the developer regulating member 73. Each of the cooling bars 91*a* and 91*b* contacts the inner surface of the metal plate member of the developer regulating member 73 facing the space (S) to transfer heat therefrom. The cooling bars 91*a* and 91*b* have pentagonal and rectangular cross sections, respectively. The cross-sectional shape of the cooling bar is not limited to these. As illustrated in FIG. 22, a cooling fin 92, functioning as a heat dissipating member, may be attached to at least one of the end portions of the cooling bar 91*a* or 91*b* protruding from the developing device 61 and exposed to the outside. The cooling fin 92 dissipates the heat transferred to the cooling bar 91*a* or 91*b* from the developer regulating member 73. As an alternative to the cooling fin 92, as illustrated in FIG. 23, the fan 90 may be used to supply air to the end portion of the cooling bar 91*a* or 91*b*, thus forcibly cooling it and enhancing the heat transfer process.

When cooling the developer regulating member 73 by using an airflow or a cooling gas, if the space (S) in the developer regulating member 73 is not airtight, air or cooling gas may leak and enter into the developing device 61. In this case, the leaking air or gas may cause toner scattering in the developing device 61, deteriorating the developer performance. Further, when using a fan to supply air into the developer regulating member 73, the noise caused by the fan needs to be minimized.

Figure 24:
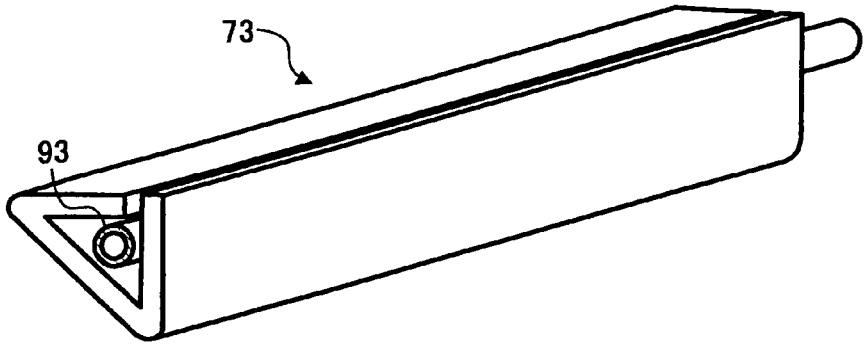
FIG. 24 is a schematic perspective view of the developer regulating member in which a cooling pipe is provided according to an alternative embodiment.
Figure 25:
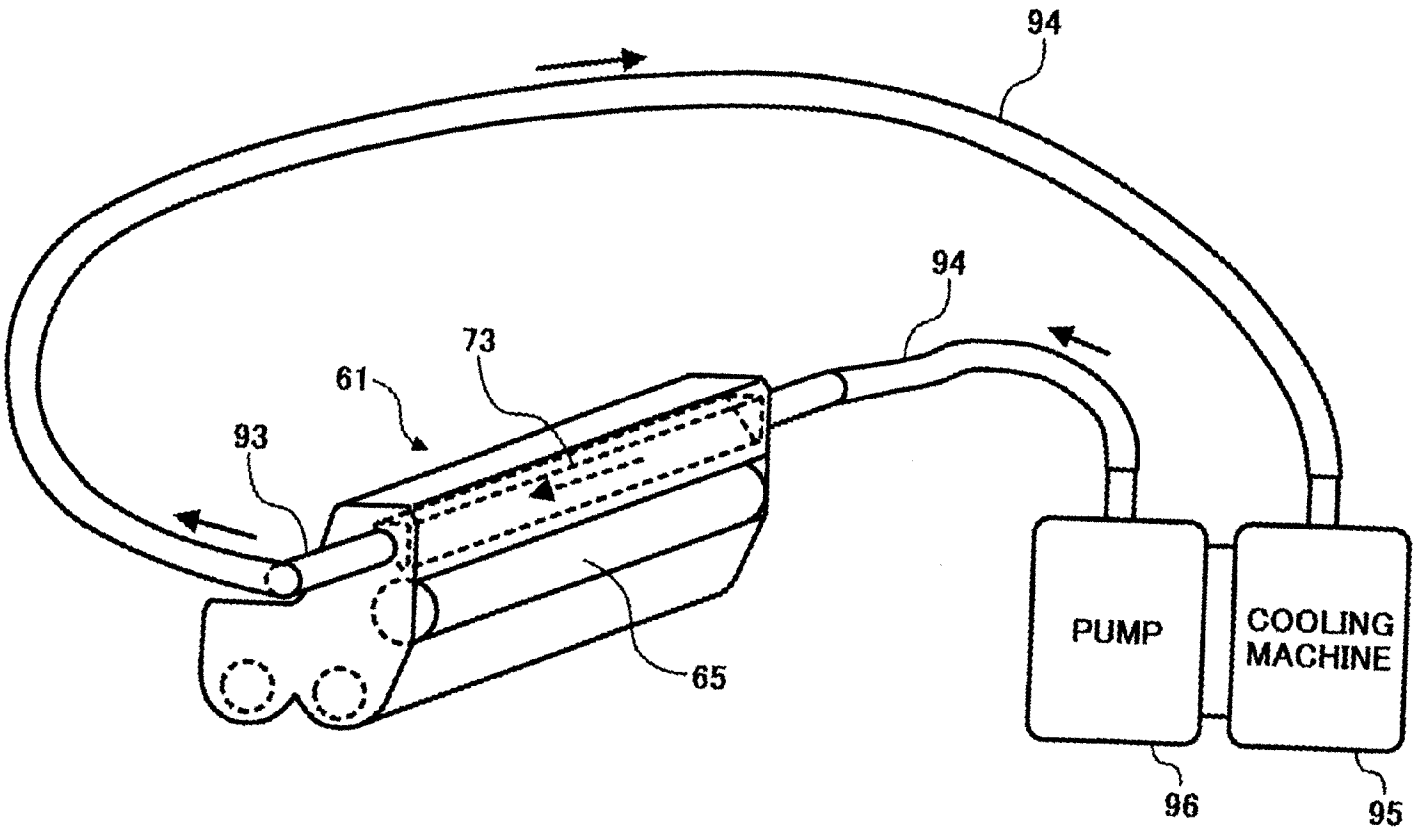
FIG. 25 is a schematic view of a cooling liquid circulating system according to another alternative embodiment.

Alternatively, a cooling gas or liquid flowing inside of a cooling pipe 93 running through the space(s) may be used to cool the developer regulating member 73, as illustrated in FIG. 24. The cooling pipe 93 may be a flexible tube or a metallic pipe having a high rigidity. FIG. 25 is a schematic view of a cooling liquid circulating system according to an alternative example. As illustrated in FIG. 25, for example, a cooling liquid cooled by a cooling machine 95 is supplied into the cooling pipe 93 by a pump 96, while circulating the cooling liquid through a circulating pipe 94. As a non-limiting example, an aqueous solution of ethylene glycol may be used as the cooling liquid.

If the space (S) in the developer regulating member 73 is an enclosed space, a cooling liquid may flow through the space (S) in the developer regulating member 73 without using the cooling pipe 93. In this case, the cooling liquid directly contacts the inner surface of the metal plate member of the developer regulating member 73 facing the space (S), thereby cooling the developer regulating member 73 more efficiently.

When cooling the developer regulating member 73 using the cooling bars 91*a* and 91*b* and the cooling liquid flowing through the space (S), the above-described toner scattering problem caused by leaking air or cooling gas in the developing device 61 can be prevented. Further, because the above-described fan for supplying air into the developer regulating member 73 need not be used, the overall noise level can be reduced.

In the above-described developer regulating member, the developer regulating part is made of a metal material having a thermal conductivity higher than that of a plastic material. Therefore, as compared to a case in which a developer regulating part is made of a plastic, the heat generated at the developer regulating part can be more quickly transmitted to the entire inner surface of the metallic developer regulating member. Further, by cooling the developer regulating member from its inner surface side, the heat transmitted thereto from the developing device can be dissipated from the developer regulating member. As described above, the heat in the space of the developer regulating member can be expelled therefrom by using an airflow, a cooling bar, or a cooling liquid. In the developing device 61 having such a construction, the developer temperature rise caused by the heat produced at the developer regulating position of the developer regulating member can be efficiently controlled.

The developer regulating member formed from a single member is free from a heat resistance which may be generated at a boundary portion between a plurality of members. Therefore, the heat generated at the developer regulating part can be quickly transmitted to the entire inner surface of the metal member of the developer regulating member facing the space.

In the above-described developer regulating member, at least the developer regulating part may be formed by bending a metallic plate member. Due to a press bending process of the metallic plate member, the hollow developer regulating member can be easily formed.

Moreover, the above-described developer regulating member is formed from a metallic plate member having a high heat conductivity and a high rigidity. Therefore, the rise in developer temperature caused by the heat produced at the developer regulating position can be efficiently restrained. In addition, the strength of the developer regulating member can be increased.

As described above, the developer regulating member 73 is formed by bending a metallic plate member at two bending positions. Generally, as the number of bending positions increases, the rigidity of an overall metallic plate member increases, and the resulting metallic plate member is not easily deformed. Therefore, as compared to the background developer regulating member 110 of FIG. 1 formed by bending a metallic plate member at one bending position, the developer regulating member 73 has a higher flexural strength. Even if the stress produced by the above-described wedge effect is exerted on the developer regulating member 73, the bent part (i.e., the developer regulating part 73*a*) is not deformed, and the leading edge surface of the developer regulating part 73*a* is not displaced. Therefore, the amount of developer passing through the developer regulating gap around the center portion of the developer regulating member is prevented, thereby obviating the uneven image density problem.

Further, the developer regulating member 73 is disposed such that the edge line portion of the bent developer regulating part 73*a* opposes the surface of the developing sleeve 65. The curved surface including the edge line portion of the developer regulating part 73*a* regulates the amount of the developer carried and conveyed on the developing sleeve 65. The edge line portion of the developer regulating part 73*a* formed by a press bending process is in a shape of a uniform curved surface, and is substantially even in its longitudinal direction. As compared to the leading edge surface 111 of the background L-shaped developer regulating member 110 of FIG. 1 formed by a press cutting process, the edge line portion of the developer regulating part 73*a* of the developer regulating member 73 has a uniform surface in its longitudinal direction. Thus, the developer regulating member 73 can regulate the amount of the developer carried on the developing sleeve 65 such that the amount of developer scooped up is evenly distributed along its axial direction.

Further, the surface of the developer regulating part 73*a* that contacts the developer carried on the developing sleeve 65 typically deforms when the developer temperature rises at the developer regulating position. It is desirable that the surface of the developer regulating part 73*a* does not deform in order to stabilize the amount of developer scooped up. Therefore, the frictional heat generated at the developer regulating position needs to be dissipated.

In the case of the background L-shaped developer regulating member 110, the leading edge surface 111 in contact with the developer is flat. On the other hand, the developer regulating part 73*a* has a curved edge line portion in a line-contact with a developer. With such a line-contact, the friction between the developer regulating part 73*a* and developers can be reduced while decreasing a contact area between the developer regulating part 73*a* and developers, thereby reducing the frictional heatgenerated. Further, there is a space at the downstream side of the developer regulating part 73*a* contacting the developer in the moving direction of the surface of the developing sleeve 65, increasing an area of the surface of the developer regulating member 73 in contact with air. With such a construction, heat can be efficiently dissipated into the air.

Figure 26:
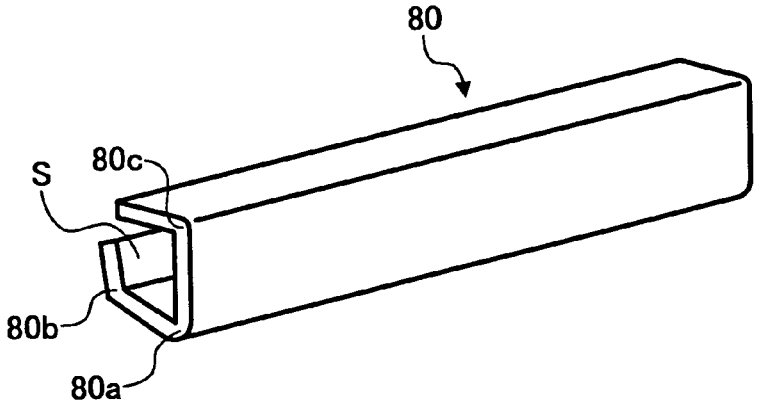
FIG. 26 is a schematic perspective view of a developer regulating member according to an alternative embodiment.

FIG. 26 is a schematic perspective view of a developer regulating member according to another alternative example. As illustrated in FIG. 26, a developer regulating member 80 is formed by bending a metal plate member at a plurality of bending lines (three bending lines in FIG. 26), resulting in a substantially polygonal cross section. The hollow developer regulating member 80 includes three bent parts 80*a*, 80*b*, and 80*c*, and a space (S) that extends in a direction perpendicular to the moving direction of the surface of the developing sleeve 65, that is, in a longitudinal direction of the developer regulating member 80 along the rotational axis of the developing sleeve 65. Because the developer regulating member 80 is formed by bending a metallic plate member at a plurality of bending positions, the developer regulating member 80 has a higher flexural strength than that of the background developer regulating member 110 of FIG. 1 metallic plate. Even if the stress produced by the above-described wedge effect is exerted on the developer regulating member 80, the bent part (i.e., the developer regulating part 80*a*) is not deformed, and the leading edge surface of the developer regulating part 80*a* is not displaced. Therefore, the amount of developer passing through the developer regulating gap around the center portion of the developer regulating member is prevented, thereby obviating the uneven image density problem.

Further, the developer regulating member 80 is also disposed such that the edge line portion of the bent developer regulating part 80*a* opposes the surface of the developing sleeve 65. The curved surface, including the edge line portion of the developer regulating part 80*a*, regulates the amount of the developer carried on the developing sleeve 65. The edge line portion of the developer regulating part 80*a* formed by a press bending process is in a shape of a uniform curved surface and is substantially even in its longitudinal direction. As compared to the leading edge surface 111 of the background L-shaped developer regulating member 110 of FIG. 1 formed by a press cutting process, the edge line portion of the developer regulating part 80*a* has a uniform surface in its longitudinal direction. Thus, the developer regulating member 80 can regulate the amount of the developer carried on the developing sleeve 65 such that the amount of developer scooped up is evenly distributed along its axial direction. Moreover, the heat generated at the developer regulating part 80*a* can be quickly transmitted to and dissipated through the inner surface of the metal plate member of the developer regulating member 80 facing the space (S).

Figure 27:
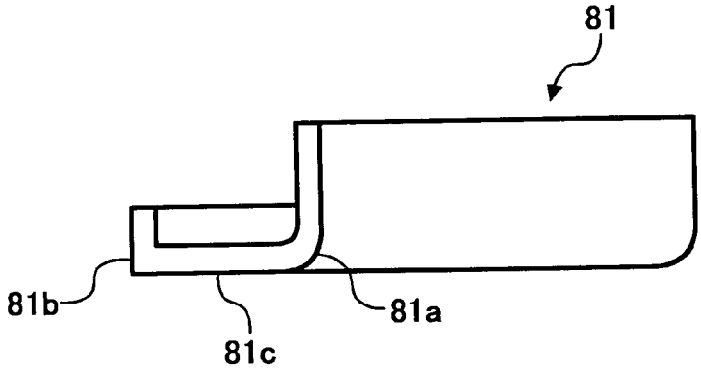
FIG. 27 is a schematic perspective view of a developer regulating member according to yet another alternative embodiment.
Figure 28:
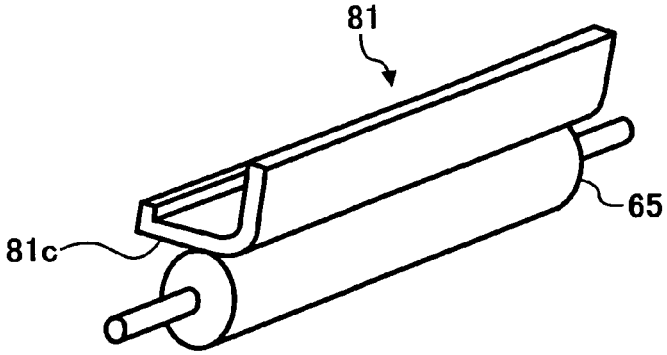
FIG. 28 is a schematic perspective view of the developer regulating member of FIG. 27 and a developing sleeve.

FIG. 27 is a schematic perspective view of a developer regulating member according to another alternative example. As illustrated in FIG. 27, a developer regulating member 81 is formed by bending a metallic plate member at two bending lines. The developer regulating member 81 includes two bent parts 81*a* and 81*b*, and a flat part 81*c* formed between the bent parts 81*a* and 81*b*. As illustrated in FIG. 28, the flat part 81*c* is provided opposite to the surface of the developing sleeve 65 with a predetermined gap to regulate the amount of the developer carried thereon. In the developer regulating member 81 having the flat part 81*c* as a developer regulating part, because the developer regulating member 81 is formed by bending a metallic plate member at a plurality of bending positions, the developer regulating member 81 has a higher flexural strength than that of the background developer regulating member 110 of FIG. 1 metallic plate . Even if the stress produced by the above-described wedge effect is exerted on the developer regulating member 81, the bent parts 81*a* and 81*b* are not deformed, and the developer regulating surface of the flat part 81*c* is not displaced. Therefore, the amount of developer passing through the developer regulating gap around the center portion of the developer regulating member is prevented, thereby obviating the uneven image density problem.

Further, as compared to the leading edge surface 111 of the background developer regulating member 110 of FIG. 1 formed by a press cutting process, the flat part 81*c* has a uniform flat surface in its longitudinal direction. Thus, the developer regulating member 81 can evenly regulate the amount of the developer carried on the developing sleeve 65 along its axial direction.

As described above, each of the developer regulating members 73, 80, and 81 is formed by bending a metallic plate member at a plurality of bending positions. With such developer regulating members, even if the stress produced by the above-described wedge effect is exerted on the developer regulating member, the bent parts are not typically deformed, and the developer regulating surface is prevented from being displaced. Therefore, the amount of developer passing through the developer regulating gap around the center portion of the developer regulating member is prevented, thereby obviating the uneven image density problem. Further, in the developer regulating members 73, 80, and 81, an edge line part of the bent part, and the flat part formed between the two bent parts formed by a press bending process function as a developer regulating part. In such developer regulating members, as compared to the leading edge surface of the background L-shaped developer regulating member, the developer regulating part of the developer regulating member has a uniform surface in its longitudinal direction. Thus, the developer regulating member can adequately and evenly regulate the amount of developer carried on a developer carrier along its longitudinal direction.

The present invention has been described with respect to the exemplary embodiments illustrated in the figures. However, the present invention is not limited to these embodiments and may be practiced otherwise.

In the embodiments, the air supplying device, such as the fan 90, supplies air into the space in the developer regulating member 73. However, the fan 90 may supply air into each space in the developer regulating members 74, 75, 76, 77, 78, 79, 80, and 81.

In the embodiments, the cooling bars 91*a* and 91*b* and the cooling pipe 93 run through the space in the developer regulating member 73. However, the cooling bars 91*a* and 91*b* and the cooling pipe 93 may run through each space in the developer regulating members 74, 75, 76, 77, 78, 79, 80, and 81.

The present invention has been described with respect to a copying machine as an example of an image forming apparatus. However, the present invention may be applied to other image forming apparatuses, such as a printer, a facsimile machine, etc. or a multi-functional image forming apparatus.

Moreover, in place of the full-color copying machine, a mono-color copying machine may also be used.

Numerous additional modifications and variations of the present invention are possible in light of the above teachings. It is therefore understood that within the scope of the appended claims, the present invention may be practiced other than as specifically described herein.

What is claimed is:

1. A developer regulating member, comprising:

a developer regulating part adapted to oppose a surface of a developer carrier adapted to regulate an amount of developer carried and conveyed by the developer carrier, wherein the developer regulating member is formed from a metallic plate member and comprises a space facing an inner surface of the metallic plate member and being adapted to extend in a direction perpendicular to a moving direction of the surface of the developer carrier, the developer regulating member is formed by bending the metallic plate member at a plurality of positions forming a plurality of bent parts, the developer regulating part is constructed from an edge line portion of one bent part of the plurality of bent parts, the developer regulating member has a substantially triangular cross section, and an angle formed between two sides at any one bent part of the plurality of bent parts is less than 90 degrees.

2. The developer regulating member according to claim 1, wherein the developer is substantially continuous at a location adapted to be provided opposite to the surface of the developer carrier.

3. The developer regulating member according to claim 1, wherein a cooling medium contacts the inner surface of the metallic member facing the space.

4. The developer regulating member according to claim 1, wherein the metallic member comprises a single metallic plate member and at least the developer regulating part is formed by bending the metallic plate member.

5. The developer regulating member according to claim 1, wherein the metallic member is a metallic plate member, the developer regulating member is formed by bending the metallic plate member at a plurality of positions forming a plurality of bent parts, and the developer regulating part is constructed from a flat part formed between two bent parts of the plurality of bent parts.

6. The developer regulating member according to claim 1, wherein the developer regulating member has a substantially polygonal cross section.

7. A developing device, comprising:

a developer carrier configured to carry and convey a developer; and a developer regulating member comprising:

a developer regulating part opposing a surface of the developer carrier configured to regulate the developer carried and conveyed by the developer carrier, wherein the developer regulating member is formed from a metallic plate member and comprises a space facing an inner surface of the metallic plate member and extending in a direction perpendicular to a moving direction of the surface of the developer carrier, the developer regulating member is formed by bending the metallic plate member at a plurality of positions forming a plurality of bent parts, the developer regulating part is constructed from an edge line portion of one bent part of the plurality of bent parts, the developer regulating member has a substantially triangular cross section, and an angle formed between two sides at any one bent part of the plurality of bent parts is less than 90 degrees.

8. The developing device according to claim 7, further comprising a cooling device configured to cool the developer regulating member from an inner surface side of the metal member facing the space.

9. The developing device according to claim 8, wherein the cooling device is configured to supply gas into the space.

10. The developing device according to claim 9, wherein a temperature of the gas supplied by the cooling device is lower than a temperature of ambient air.

11. The developing device according to claim 8, wherein the cooling device is configured to flow a cooling liquid through the space.

12. The developing device according to claim 8, wherein the cooling device comprises a bar-shaped heat transferring member configured to transfer heat from the developer regulating member and disposed such that the heat transferring member runs through the space, and a heat dissipating member configured to dissipate the heat from an end portion of the heat transferring member.

13. The developing device according to claim 7, wherein the cooling device cools the developer regulating member by contacting a cooling medium with the inner surface of the metallic member facing the space.

14. The developing device according to claim 7, wherein the metallic member is a single metallic plate member, and at least the developer regulating part is formed by bending the metallic plate member.

15. The developing device according to claim 7, wherein the developer regulating part is spaced from the surface of the developer carrier.

16. The developing device according to claim 7, wherein the metallic member is a metallic plate member, the developer regulating member is formed by bending the metallic plate member at a plurality of positions forming a plurality of bent parts, and the developer regulating part is constructed from a flat part formed between two bent parts of the plurality of bent parts.

17. The developing device according to claim 7, wherein the developer regulating member has a substantially polygonal cross section.

18. The developing device according to claim 7, wherein the developer comprises a toner and a magnetic carrier, and a particle diameter of the magnetic carrier is from about 20 μm to about 50 μm.

19. The developing device according to claim 7, wherein the developer comprises a toner and a magnetic carrier, the magnetic carrier includes a core material and a coating layer covering the core material, and the coating layer contains a melamine resin crosslinked with a thermoplastic resin and a charge controlling agent.

20. The developing device according to claim 7, wherein the developer comprises a toner and a magnetic carrier, and a ratio of a volume-based average particle diameter of the toner to a number-based average particle diameter of the toner is from about 1.05 to about 1.30.

21. The developing device according to claim 20, wherein the ratio of the volume-based average particle diameter of the toner to the number-based average particle diameter of the toner is from about 1.10 to about 1.25.

22. The developing device according to claim 7, wherein the developer comprises a toner and a magnetic carrier, and an average circularity of the toner is from about 0.95 to about 0.99.

23. The developing device according to claim 22, wherein the average circularity of the toner is from about 0.96 to about 0.99.

24. The developing device according to claim 23, wherein a concentration of toner particles having a circularity less than 0.95 is not greater than 10%.

25. The developing device according to claim 7, wherein the developer comprises a toner and a magnetic carrier, and the toner is prepared by dispersing a mixture of toner constituents, including at least a prepolymer, a colorant, and a release agent in an aqueous medium in the presence of a particulate resin to perform an addition polymerization reaction.

26. The developing device according to claim 7, wherein the developer comprises a toner and a magnetic carrier, and a shape factor "SF-1" of the toner calculated according to the following equation is from about 120 to about 180:

$$SF\text{-}1=\{(MXLNG)^2/\mathrm{AREA}\}\times(100\pi/4),$$

where "MXLNG" is a maximum length of a major axis of an elliptical-shaped figure obtained by projecting a toner particle on a two dimensional plane, and "AREA" is an area of the elliptical-shaped figure.

27. The developing device according to claim 7, wherein the developer comprises a toner and a magnetic carrier, a particle diameter of the magnetic carrier is from about 20 μm to about 50 μm, the magnetic carrier includes a core material and a coating layer covering the core material, the coating layer contains a melamine resin crosslinked with a thermoplastic resin and a charge controlling agent, and the toner is prepared by dispersing a mixture of toner constituents including at least a prepolymer, a colorant, and a release agent in an aqueous medium in the presence of a particulate resin to perform an addition polymerization reaction.

28. An electrophotographic image forming process cartridge for use in an image forming apparatus, comprising at least:

an image carrier configured to carry an image; and a developing device configured to develop a latent image to form a toner image on the image carrier, the developing device comprising:

a developer carrier configured to carry and convey a developer; and a developer regulating member comprising a developer regulating part opposing a surface of the developer carrier to regulate the developer carried and conveyed by the developer carrier, wherein the developer regulating member is formed from a metallic plate member and comprises a space facing an inner surface of the metallic plate member and extending in a direction perpendicular to a moving direction of the surface of the developer carrier, the developer regulating member is formed by bending the metallic plate member at a plurality of positions forming a plurality of bent parts, the developer regulating part is constructed from an edge line portion of one bent part of the plurality of bent parts, the developer regulating member has a substantially triangular cross section, and an angle formed between two sides at any one bent part of the plurality of bent parts is less than 90 degrees.

29. The electrophotographic image forming process cartridge according to claim 28, wherein the metallic member is a single metallic plate member.

30. The electrophotographic image forming process cartridge according to claim 28, further comprising a cooling device configured to cool the developer regulating member from an inner surface side of the metallic member facing the space.

31. An image forming apparatus, comprising:

an image carrier configured to carry an image;

an exposing device configured to form a latent image on a surface of the image carrier; and a developing device configured to develop the latent image to form a toner image on the image carrier, the developing device comprising:

a developer carrier configured to carry and convey a developer; and a developer regulating member comprising a developer regulating part opposing a surface of the developer carrier to regulate the developer carried and conveyed by the developer carrier, wherein the developer regulating member is formed from a metallic plate member and comprises a space that faces an inner surface of the metallic plate member, and the space extends in a direction perpendicular to a moving direction of the surface of the developer carrier, the developer regulating member is formed by bending the metallic plate member at a plurality of positions forming a plurality of bent parts, the developer regulating part is constructed from an edge line portion of one bent part of the plurality of bent parts, the developer regulating member has a substantially triangular cross section, and an angle formed between two sides at any one bent part of the plurality of bent parts is less than 90 degrees.

32. The image forming apparatus according to claim 31, wherein the metallic member is a single metallic plate member.

33. The image forming apparatus according to claim 31, further comprising a cooling device configured to cool the developer regulating member from an inner surface side of the metallic member facing the space.

* * * * *